US007990344B2

(12) United States Patent
Maeda et al.

(10) Patent No.: US 7,990,344 B2
(45) Date of Patent: Aug. 2, 2011

(54) PLASMA DISPLAY PANEL DRIVING METHOD HAVING A HIGH TEMPERATURE AND LOW TEMPERATURE DRIVING MODE AND PLASMA DISPLAY DEVICE THEREOF

(75) Inventors: Toshiyuki Maeda, Hyogo (JP); Shigeo Kigo, Osaka (JP); Yoshiki Tsujita, Osaka (JP); Naoyuki Tomioka, Osaka (JP); Takeru Yamashita, Osaka (JP); Kei Kitatani, Osaka (JP)

(73) Assignee: Panasonic Corporation, Osaka (JP)

( * ) Notice: Subject to any disclaimer, the term of this patent is extended or adjusted under 35 U.S.C. 154(b) by 330 days.

(21) Appl. No.: 11/910,345

(22) PCT Filed: Feb. 13, 2007

(86) PCT No.: PCT/JP2007/052475

§ 371 (c)(1), (2), (4) Date: Oct. 1, 2007

(87) PCT Pub. No.: WO2007/094296

PCT Pub. Date: Aug. 23, 2007

(65) Prior Publication Data

US 2009/0251389 A1 Oct. 8, 2009

(30) Foreign Application Priority Data

Feb. 14, 2006 (JP) ..... 2006-036332
Feb. 14, 2006 (JP) ..... 2006-036333

(51) Int. Cl.
*G09G 3/28* (2006.01)

(52) U.S. Cl. ..... 345/63; 345/60

(58) Field of Classification Search ..... 345/60, 345/63; 315/169.4
See application file for complete search history.

(56) References Cited

U.S. PATENT DOCUMENTS 6,630,796 B2 * 10/2003 Tokunaga et al. ..... 315/169.4
6,961,035 B2 11/2005 Endo et al.
7,592,995 B2 9/2009 Sugino et al.
2002/0036633 A1 * 3/2002 Kasahara et al. ..... 345/204

(Continued)

FOREIGN PATENT DOCUMENTS

JP 2000-227780 A 8/2000

(Continued)

OTHER PUBLICATIONS

Supplementary European Search Report for Application No. EP 07 71 4057, Jul. 31, 2009, Panasonic Corporation.

(Continued)

*Primary Examiner* — Chanh Nguyen
*Assistant Examiner* — Long Pham
(74) *Attorney, Agent, or Firm* — RatnerPrestia

(57) ABSTRACT

A plasma display panel driving method and a plasma display device estimate the highest temperature and the lowest temperature the panel can have, according to the temperature detected by the thermal sensor, and appropriately drives the panel, to improve the image display quality. Provided are at least three driving modes having different sub-field structures: a low-temperature driving mode, an ordinary-temperature driving mode, and a high-temperature driving mode. To drive the panel, estimates of the highest temperature and the lowest temperature the panel can have are made from the temperature detected by the thermal sensor, the temperature condition of the panel is determined from the estimated highest temperature or lowest temperature, and the driving mode is switched appropriately for the panel temperature condition.

3 Claims, 15 Drawing Sheets

U.S. PATENT DOCUMENTS

| | | | | |
|---|---|---|---|---|
| 2004/0021656 | A1* | 2/2004 | Kang et al. | 345/204 |
| 2005/0068262 | A1 | 3/2005 | Mizobata et al. | |

FOREIGN PATENT DOCUMENTS

| | | | |
|---|---|---|---|
| JP | 2002-244202 | A | 8/2002 |
| JP | 2004-061702 | A | 2/2004 |
| JP | 2004-151672 | A | 5/2004 |
| JP | 2005-077744 | A | 3/2005 |
| JP | 2005-241806 | A | 9/2005 |
| JP | 2007-525511 | | 10/2010 |
| KR | 10-2005-0021877 | A | 3/2005 |
| WO | WO 2006/013658 | A1 | 2/2006 |
| WO | WO 2007/097328 | A1 | 8/2007 |
| WO | WO 2007/099905 | A1 | 9/2007 |

OTHER PUBLICATIONS

International Search Report for Application No. PCT/JP2007/052475 dated Mar. 27, 2007.

* cited by examiner

PLASMA DISPLAY PANEL...

FIG. 14

| Mode at power-off | Low-temperature correction value $\Delta\theta L(t)$ | High-temperature correction value $\Delta\theta H(t)$ |
|---|---|---|
| Low-temperature driving mode | $\Delta\theta Lo$ | $\Delta\theta Ho(1-\exp(t/tH))$ |
| Ordinary-temperature driving mode | $\Delta\theta Lo(1-\exp(t/tL))$ | $\Delta\theta Ho(1-\exp(t/tH))$ |
| High-temperature driving mode | $\Delta\theta Lo(1-\exp(t/tL))$ | $\Delta\theta Ho$ |

t: time lapse from power-on

FIG. 15

| Mode at power-off | Low-temperature correction value $\Delta\theta L(t)$ | High-temperature correction value $\Delta\theta H(t)$ |
|---|---|---|
| Low-temperature driving mode | $\Delta\theta Lo$ | $\Delta\theta Ho$ |
| Ordinary-temperature driving mode | $\begin{cases} \Delta\theta Lo \times \frac{t}{tL} & (0 \le t < tL) \\ \Delta\theta Ho & (t \ge tL) \end{cases}$ | $\Delta\theta Ho$ |
| High-temperature driving mode | $\begin{cases} \Delta\theta Lo \times \frac{t}{tL} & (0 \le t < tL) \\ \Delta\theta Ho & (t \ge tL) \end{cases}$ | $\Delta\theta Ho$ |

t: time lapse from power-on

PLASMA DISPLAY PANEL DRIVING METHOD HAVING A HIGH TEMPERATURE AND LOW TEMPERATURE DRIVING MODE AND PLASMA DISPLAY DEVICE THEREOF

This application is a U.S. National Phase Application of PCT International Application PCT/JP2007/052475.

TECHNICAL FIELD

The present invention relates to a method of driving a plasma display panel for use in a wall-mounted television or a large monitor, and a plasma display device.

BACKGROUND ART

An alternating-current surface-discharging panel representative of plasma display panels (hereinafter abbreviated as "panels") has a large number of discharge cells formed between the front plate and the rear plate faced with each other.

For the front plate, a plurality of display electrode pairs, each made of a scan electrode and a sustain electrode, are formed on a front glass substrate in parallel with each other. A dielectric layer and a protective layer are formed to cover these display electrode pairs.

For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs. Then, the front plate and the rear plate are faced with each other and sealed together so that the display electrode pairs are intersected with data electrodes. A discharge gas is charged into an inside discharge space formed between the plates. Discharge cells are formed in portions where the respective display electrode pairs are faced with the corresponding data electrodes.

In a panel structured as above, gas discharge generates ultraviolet light in each discharge cell. This ultraviolet light excites the phosphors of red (R), green (G), and blue (G) so that they emit the respective colors for color display.

A general method of driving a panel is a sub-field method; one field period is divided into a plurality of sub-fields and combinations of light-emitting sub-fields provide gradation display.

Each sub-field has a setup period, an address period, and a sustain period. In the setup period, initializing discharge is generated to form wall charge necessary for the succeeding address operation on the respective electrodes. In the address period, address discharge is generated selectively in the discharge cells used to display an image, to form wall charge. Then, alternately applying sustaining pulses to the display electrode pairs each made of a scan electrode and a sustain electrode generates sustain discharge in the discharge cells having generated address discharge therein, and causes the phosphor layers of the corresponding discharge cells to emit light. Thus, an image is displayed.

It is also known that discharge characteristics change, depending on the temperature of the discharge cells in such a panel. For this reason, in a plasma display device for displaying images using such a panel, the brightness of images displayed on the panel and the drive margin during driving the panel change, depending on the panel temperature.

Proposed to address such a problem are methods of detecting the temperature of the panel, and making various kinds of corrections according to the detected temperature so that the influence of the temperature on the panel does not degrade the quality of the images displayed on the panel.

For example, Patent Document 1 discloses a plasma display device including a panel temperature detector for detecting the temperature of the panel in which the writing pulse cycles are changed according to the temperature information from the panel temperature detector.

However, because the temperature distribution of the panel is not uniform in some areas of the panel, the entire display areas are not at an equal temperature. Additionally, because the temperature of the panel significantly varies with the images displayed, accurate detection of the panel throughout the panel is difficult. For these reasons, even with correction based on the temperature of the panel detected by the panel temperature detector, optimal driving of the panel is difficult.

To address these problems, the present invention provides a panel driving method and a plasma display panel device in which the highest temperature and the lowest temperature the panel can have are estimated according to the temperature detected by a thermal sensor and the driving mode selected at power-off. Then, the panel is driven according to the estimated highest temperature or the estimated lowest temperature to improve the display quality of the images.

[Patent Document 1]

Japanese Patent Unexamined Publication No. 2004-61702

SUMMARY OF THE INVENTION

The present invention is directed to provide a method of driving a panel that includes a plurality of discharge cells having display electrodes pairs. Each of the display electrodes pairs is made of a scan electrode and a sustain electrode. One field is structured of a plurality of sub-fields. Each of the sub-fields includes a setup period for generating initializing discharge in the discharge cells, an address period for generating address discharge in the discharge cells, and a sustain period for generating sustain discharge in the discharge cells having generated the address discharge therein. To drive the panel, at least one driving mode is selected from a plurality of different driving modes having at least one different operation in the setup period, address period, and sustain period. Further, a thermal sensor is provided so that the lowest temperature and the highest temperature the panel can have is estimated according to the temperature detected by the thermal sensor and one of the driving modes based on the estimated lowest temperature and the estimated highest temperature is selected. This structure allows estimation of the temperature of the panel according to the temperature detected by the thermal sensor and the operation based on the temperature, and thus improvement of the image display quality.

Further, in the present invention, the one of the driving modes is selected according to the driving mode selected at power-off and the estimated lowest temperature and the estimated highest temperature. This structure can further improve the image display quality.

BRIEF DESCRIPTION OF THE DRAWINGS

FIG. 14 is a table showing low-temperature correction values and high-temperature correction values in the third exemplary embodiment.

FIG. 15 is a table showing low-temperature correction values and high-temperature correction values in another exemplary embodiment of the present invention.

REFERENCE MARKS IN THE DRAWINGS

Figure 1:
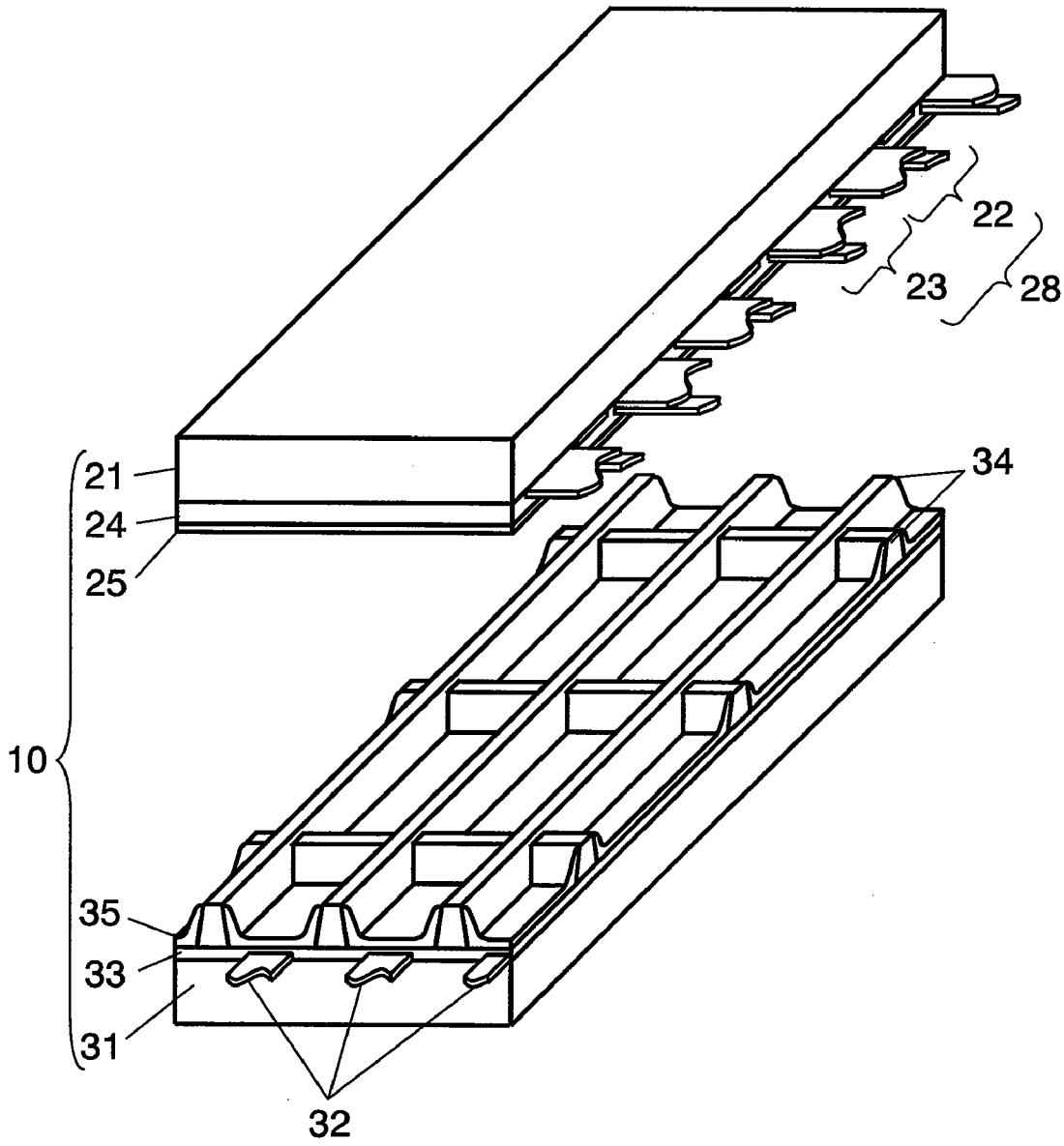
FIG. 1 is an exploded perspective view illustrating a structure of a panel in accordance with a first exemplary embodiment of the present invention.

1 Plasma display device
10 Panel
21 Front plate
22 Scan electrode
23 Sustain electrode
24, 33 Dielectric layer
25 Protective layer
31 Rear plate
32 Data electrode
34 Barrier rib
35 Phosphor layer
51 Image signal processing circuit
52 Data electrodes driver circuit
53 Scan electrodes driver circuit
54 Sustain electrodes driver circuit
55 Timing generating circuit
58 Temperature estimating circuit
81 Temperature sensor
82 Timer
83 Storage
86 Heat-conductive sheet
87 Aluminum chassis
88 Boss material
89 Circuit board
100, 200 Sustaining pulse generating circuit
110 Power recovery circuit
300 Reset waveform generating circuit
310, 320 Miller integrator circuit
400 Scanning pulse generating circuit

DETAILED DESCRIPTION OF PREFERRED EMBODIMENTS

Hereinafter, a description is provided of a plasma display device in accordance with exemplary embodiments of the present invention, with reference to the accompanying drawings.

First Exemplary Embodiment

FIG. 1 is an exploded perspective view illustrating a structure of panel 10 in accordance with the first exemplary embodiment of the present invention. A plurality of display electrode pairs 28, each made of scan electrode 22 and sustain electrode 23, are formed on glass front plate 21. Dielectric layer 24 is formed to cover scan electrodes 22 and sustain electrodes 23. Protective layer 25 is formed over dielectric layer 24. A plurality of data electrodes 32 are formed on rear plate 31. Dielectric layer 33 is formed to cover data electrodes 32. On the dielectric layer, barrier ribs 34 are formed in a double cross. Further, over the side faces of barrier ribs 34 and dielectric layer 33, phosphor layers 35 for emitting red (R), green (G), or blue (B) light are provided.

These front plate 21 and rear plate 31 are faced with each other sandwiching a small discharge space therebetween so that display electrode pairs 28 are intersected with data electrodes 32. The outer peripheries of the plates are sealed with a sealing material, such as a glass frit. In the discharge space, a mixed gas of neon and xenon, for example, is charged as a discharge gas. In this exemplary embodiment, a discharge gas having a xenon partial pressure of 10% is used to improve the brightness. The discharge space is partitioned into a plurality of compartments by barrier ribs 34. Discharge cells are formed at intersections between display electrode pairs 28 and data electrodes 32. Discharging and lighting in these discharge cells allows image display.

The structure of the panel is not limited to the above, and may include stripe-like barrier ribs.

Figure 2:
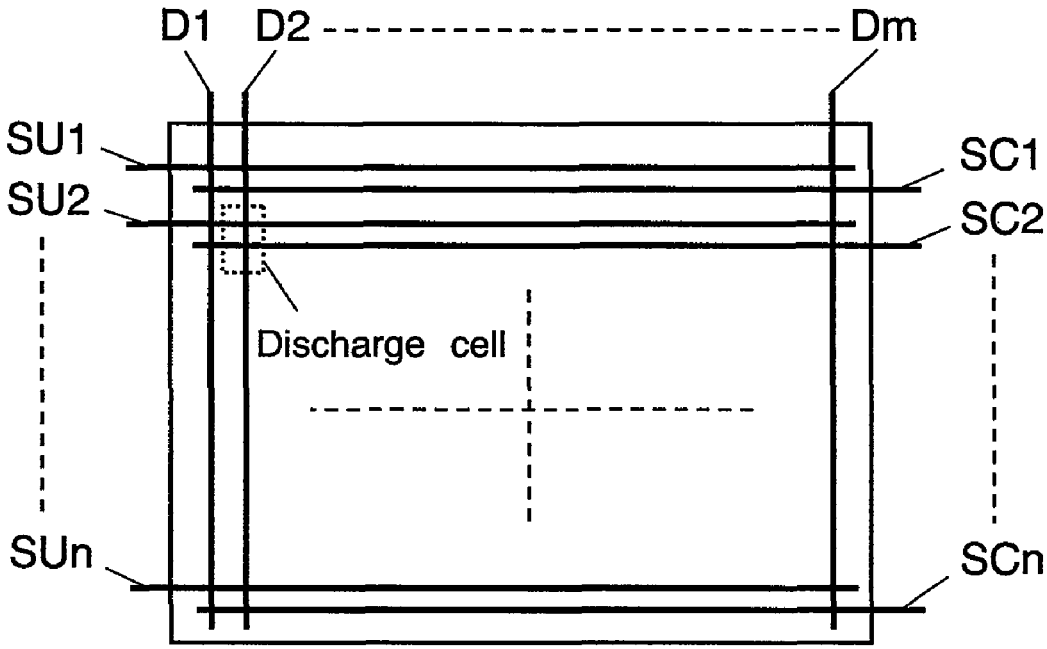
FIG. 2 is a diagram illustrating an array of electrodes of the panel.

FIG. 2 is a diagram showing an array of electrodes in panel 10 in accordance with the first exemplary embodiment of the present invention. Panel 10 includes n scan electrodes SC1 to SCn (scan electrodes 22 in FIG. 1) and n sustain electrodes SU1 to SUn (sustain electrodes 23 in FIG. 1) both long in the row direction, and m data electrodes D1 to Dm (data electrodes 32 in FIG. 1) long in the column direction. A discharge cell is formed in a portion in which a pair of scan electrode SCi (i=1 to n) and sustain electrode SUi are intersected with one data electrode Dj (j=1 to m). Thus, m×n discharge cells are formed in the discharge space.

Figure 3:
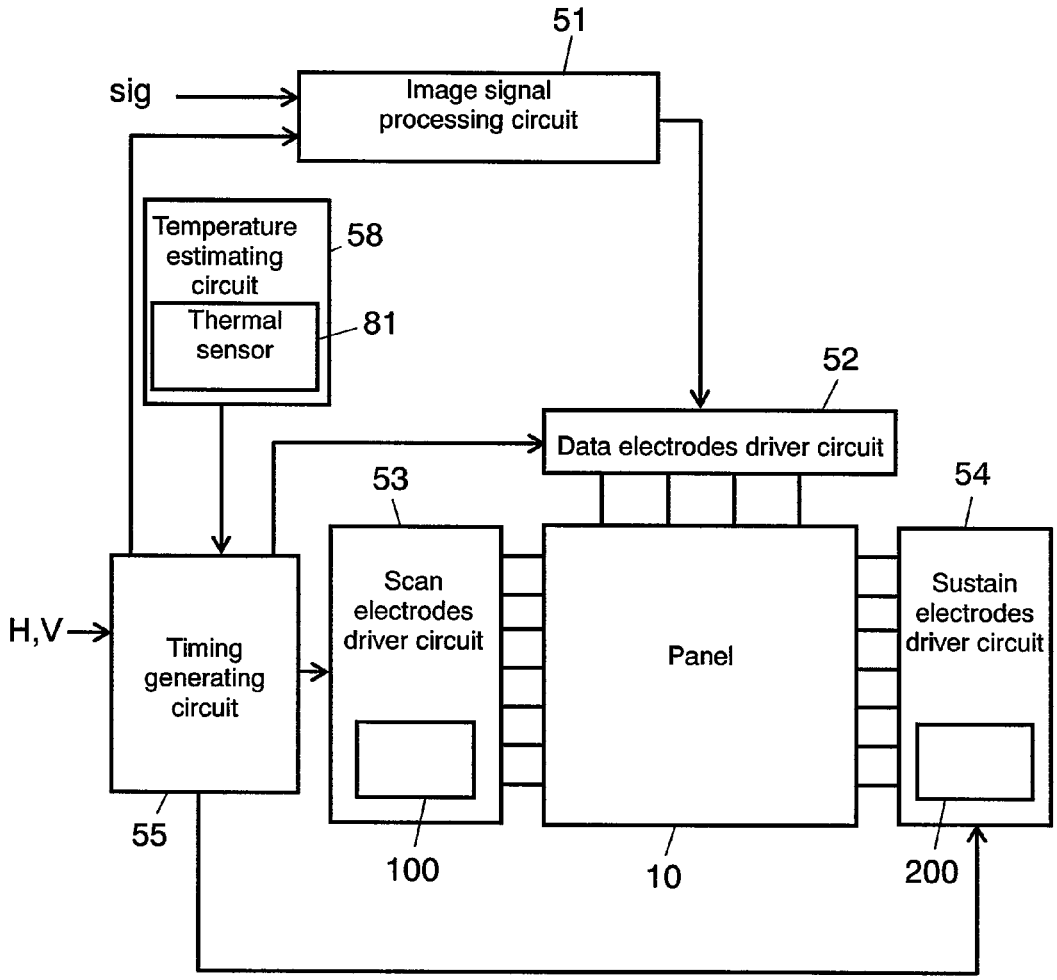
FIG. 3 is a circuit block diagram of a plasma display device including the panel.

FIG. 3 is a circuit block diagram of a plasma display device in accordance with the first exemplary embodiment. Plasma display device 1 includes panel 10, image signal processing circuit 51, data electrodes driver circuit 52, scan electrodes driver circuit 53, sustain electrodes driver circuit 54, timing generating circuit 55, temperature estimating circuit 58, and power supply circuits (not shown) for supplying necessary power to the respective circuit blocks.

Image signal processing circuit 51 converts supplied image signal sig into image data showing whether the discharge cells are lit or not per sub-field. Data electrodes driver circuit 52 converts the image data per sub-field into signals corresponding to respective data electrodes D1 to Dm, and drives respective data electrodes D1 to Dm.

Temperature estimating circuit 58 includes thermal sensor 81 made of a commonly known element for detecting temperatures, such as a thermocouple. Temperature estimating circuit 58 calculates estimations of the highest temperature and lowest temperature panel 10 can have (hereinafter simply referred to as "estimated highest temperature" and "estimated lowest temperature") from the temperature of the periphery of panel 10 detected by thermal sensor 81, i.e. the temperature inside of the housing in this exemplary embodiment, and supplies the results to timing generating circuit 55.

Timing generating circuit 55 generates various kinds of timing signals for controlling the operation of each circuit block based on horizontal synchronizing signal H, vertical synchronizing signal V, and the highest temperature and the lowest temperature estimated by temperature estimating circuit 58, and supplies the timing signals to each circuit block. Scan electrodes driver circuit 53 includes sustaining pulse generating circuit 100 for generating sustaining pulses to be applied to scan electrodes SC1 to SCn in the sustain period, and drives respective scan electrodes SC1 to SCn according to the timing signals. Sustain electrodes driver circuit 54 includes sustaining pulse generating circuit 200 for generating sustaining pulses to be applied to sustain electrodes SU1 to SUn in the sustain period, and drives respective sustain electrodes SU1 to SUn.

Figure 4A:
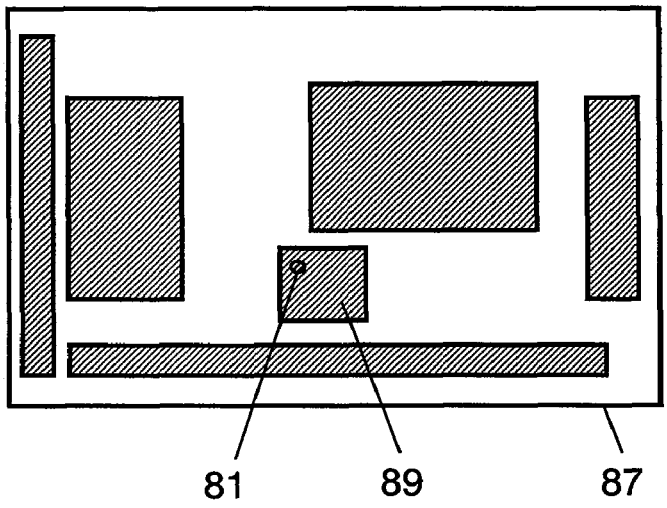
FIG. 4A is a rear view of the plasma display device showing a position of a thermal sensor installed in the plasma display device in accordance with the first exemplary embodiment.
Figure 4B:
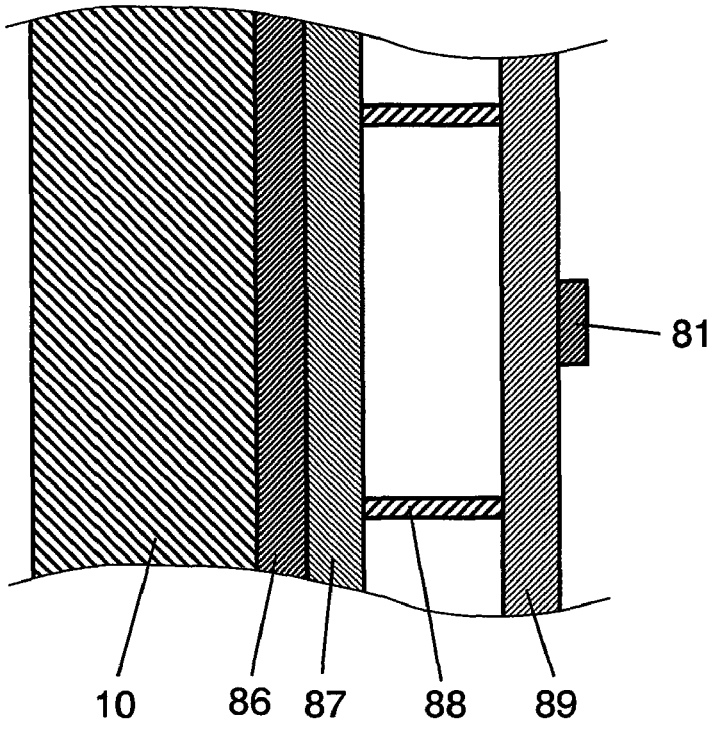
FIG. 4B is an enlarged sectional view of the plasma display device showing the position of the thermal sensor installed in the plasma display device in accordance with the first exemplary embodiment.

FIG. 4A and FIG. 4B are drawings showing a position of the thermal sensor installed in the plasma display device of the first exemplary embodiment. FIG. 4A is a rear view of the plasma display device. FIG. 4B is an enlarged sectional view of the plasma display device. On the rear side of panel 10, heat-conductive sheet 86 is provided in intimate contact therewith. Further, aluminum chassis 87 is provided on heat-conductive sheet 86 in intimate contact therewith. Circuit board 89 including the respective driver circuits is disposed over aluminum chassis 87 via boss materials 88. Temperature sensor 81 is disposed on the surface of circuit board 89.

Thus, panel 10 and thermal sensor 81 are spaced with each other, sandwiching an air space therebetween. Temperature sensor 81 is disposed in a position having no direct contact with panel 10, and is not directly thermally coupled with panel 10.

As described above, in this exemplary embodiment, thermal sensor 81 is provided in a position having no direct contact with panel 10, heat-conductive sheet 86, or aluminum chassis 87. Disposing an air space formed by boss materials 88 between panel 10 and thermal sensor 81 prevents thermal sensor 81 from making direct contact with panel 10, and from detecting local heat of panel 10. Temperature sensor 81 may be installed in another position if the structure prevents the thermal sensor from being directly thermally coupled with panel 10.

Next, a description is provided of driving voltage waveforms for driving panel 10 and the operation thereof. Plasma display panel 1 provides gradation display by the sub-field method: one field period is divided into a plurality of sub-fields and whether to light the respective discharge cells or not is controlled for each sub-field. Each sub-field has a setup period, an address period, and a sustain period.

In the setup period, initializing discharge is generated to form wall charge necessary for the succeeding address discharge, on the respective electrodes. At this time, one of an all-cell initializing operation and a selective initializing operation is performed. The all-cell initializing operation causes initializing discharge in all the discharge cells (hereinafter abbreviated as "all-cell initializing operation"). The selective initializing operation causes initializing discharge selectively in the discharge cells having generated sustain discharge therein (hereinafter "selective initializing operation"). In the address period, address discharge is generated selectively in the discharge cells to be lit so as to form wall charge. In the sustain period, alternate application of the number of sustaining pulses proportional to the brightness weight to display electrode pairs causes sustain discharge in the discharge cells having generated address discharge therein for light emission. This proportionality factor is called a luminance factor. The sub-field structure is detailed later. Now, the driving voltage waveforms in the sub-fields and the operation thereof are described.

Figure 5:
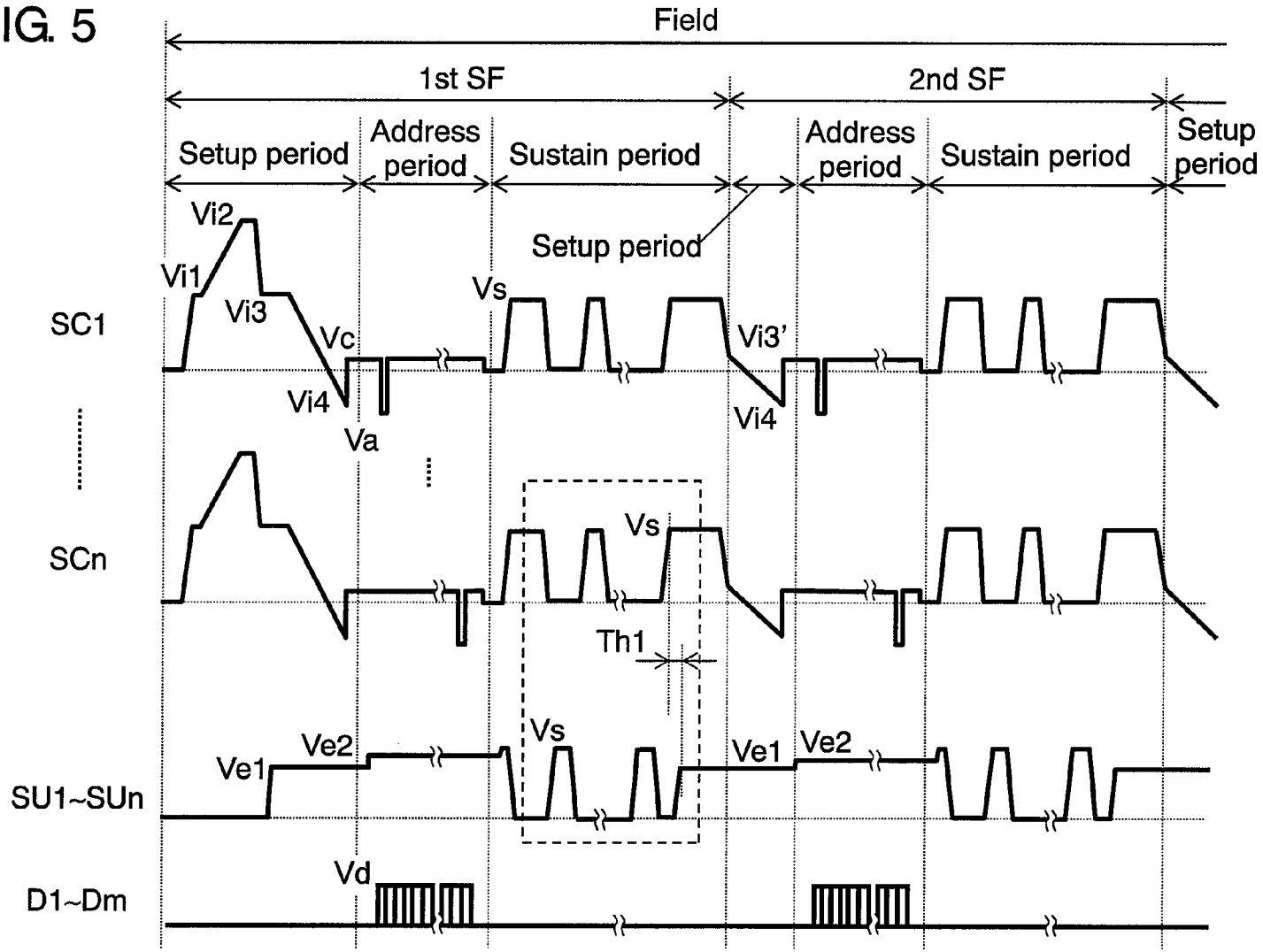
FIG. 5 is a diagram showing driving voltage waveforms applied to respective electrodes of the panel.

FIG. 5 is a diagram showing driving voltage waveforms applied to respective electrodes of panel 10 of the first exemplary embodiment of the present invention. FIG. 5 shows a sub-field in which the all-cell initializing operation is performed and a sub-field in which the selective initializing operation is performed.

First, a description is provided of the sub-field in which the all-cell initializing operation is performed.

In the first half of the setup period, a voltage of 0(V) is applied to respective data electrodes D1 to Dm and sustain electrodes SU1 to SUn. Applied to scan electrodes SC1 to SCn is a ramp waveform voltage that gradually increases from voltage Vi1 of a breakdown voltage or lower to a voltage exceeding the breakdown voltage with respect to sustain electrodes SU1 to SUn. (Hereinafter, the maximum value of the gradually increasing voltage applied to scan electrodes SC1 to SCn in the first half of the setup period is used as "setup voltage Vr".)

While this ramp waveform voltage is increasing, weak initializing discharge occurs between scan electrodes SC1 to SCn and sustain electrodes SU1 to SUn, and between scan electrodes SC1 to SCn and data electrodes D1 to Dm. Then, negative wall voltage accumulates on scan electrodes SC1 to SCn. Positive wall voltage accumulates on data electrodes D1 to Dm and sustain electrodes SU1 to SUn. Now, the wall voltage on the electrodes means the voltage generated by wall charge accumulated on the dielectric layer, protective layer, phosphor layers, or the like covering the electrodes.

In the second half of the setup period, a positive voltage of Ve1 is applied to sustain electrodes SU1 to SUn. Applied to scan electrodes SC1 to SCn is a gradually decreasing ramp waveform voltage (hereinafter "ramp voltage") from voltage Vi3 of the breakdown voltage or lower to voltage Vi4 exceeding the breakdown voltage with respect to sustain electrodes SU1 to SUn. During this application, weak initializing discharge occurs between scan electrodes SC1 to SCn and sustain electrodes SU1 to SUn, and between scan electrodes SC1 to SCn and data electrodes D1 to Dm. This weak discharge weakens the negative wall voltage on scan electrodes SC1 to SCn and the positive wall voltage on sustain electrodes SU1 to SUn, and adjusts the positive wall voltage on data electrodes D1 to Dm to a value appropriate for the address operation. Thus, the all-cell initializing operation for causing initializing discharge in all the discharge cells is completed.

In the succeeding address operation, voltage Ve2 is applied to sustain electrodes SU1 to SUn, and voltage Vc is applied to scan electrodes SC1 to SCn. Next, negative scanning pulse voltage Va is applied to scan electrode SC1 in the first row, and positive addressing pulse voltage Vd is applied to data electrodes Dk (k=1 to m) of the discharge cells to be lit in the first row. At this time, the voltage difference at the intersections between data electrodes Dk and scan electrode SC1 is the addition of the difference in externally applied voltage (Vd–Va), and the difference between the wall voltage on data electrodes Dk and the wall voltage on scan electrode SC1, thus exceeding the breakdown voltage. Then, address discharge occurs between data electrodes Dk and scan electrode SC1, and between sustain electrode SC1 and scan electrode SC1. Positive wall voltage accumulates on scan electrode SC1 and negative wall voltage accumulates on sustain electrode SU1. Negative wall voltage also accumulates on data electrodes Dk.

In this manner, the address operation is performed to cause address discharge in the discharge cells to be lit in the first row, and to accumulate wall voltage on the respective electrodes. On the other hand, because the voltage at the intersections between data electrodes D1 to Dm subjected to no addressing pulse voltage Vd and scan electrode SC1 does not exceed the breakdown voltage, address discharge does not occur. The above address operation is performed on the discharge cells in the n-th rows and the address period is completed.

In the succeeding sustain period, the plasma display device is driven using the power recovery circuit to reduce power consumption. The driving voltage waveforms are detailed later. Now, the outline of the sustain operation in the sustain period is described.

First, positive sustaining pulse voltage Vs is applied to scan electrodes SC1 to SCn, and 0(V) is applied to sustain electrodes SU1 to SUn. Then, in the discharge cells having generated address discharge therein, the voltage difference between scan electrode SCi and sustain electrode SUi is the addition of sustaining pulse voltage Vs and the difference between the wall voltage on scan electrode SCi and the wall voltage on sustain electrode SUi, thus exceeding the breakdown voltage. Then, sustain discharge occurs between scan electrode SCi and sustain electrode SUi, and ultraviolet light generated at this time causes phosphor layers 35 to emit light. Thus, negative wall voltage accumulates on scan electrode SCi, and positive wall voltage accumulates on sustain electrodes SUi. Positive wall voltage also accumulates on data electrodes Dk. In the discharge cells having generated no address discharge in the address period, no sustain discharge occurs and the wall voltage at the completion of the setup period is maintained.

Successively, 0(V) is applied to scan electrodes SC1 to SCn, and sustaining pulse voltage Vs is applied to sustain electrode SU1 to SUn. Then, in the discharge cell having generated sustain discharge therein, the voltage difference between sustain electrode SUi and scan electrode SCi exceeds the breakdown voltage, thereby causing sustain discharge between sustain electrode SUi and scan electrode SCi again. Thus, negative wall voltage accumulates on sustain electrode SUi, and positive wall voltage on scan electrode SCi. Similarly, the number of sustaining pulses resulting from multiplying the brightness weight by the luminance factor is alternately applied to scan electrodes SC1 to SCn and sustain electrodes SU1 to SUn to give a potential difference between the electrodes of display electrode pairs. Thus, sustain discharge is continued in the discharge cells having generated address discharge therein in the address period.

At the end of the sustain period, applying voltage Ve1 to sustain electrodes SU1 to SUn specific period Th1 after the application of voltage Vs to scan electrodes SC1 to SCn gives a voltage difference so-called a narrow pulse between scan electrodes SC1 to SCn and sustain electrodes SU1 to SUn. Thereby, while positive wall voltage remains on data electrodes Dk, the wall voltage on scan electrode SCi and sustain electrode SUi is erased.

Next, a description is provided of the operation in the sub-field for the selective initializing operation.

In the setup period in the selective initializing operation, voltage Ve1 is applied to sustain electrodes SU1 to SUn, and 0(V) is applied to data electrodes D1 to Dm. A ramp voltage gradually decreasing from voltage Vi3' to voltage Vi4 is applied to scan electrodes SC1 to SCn. In the discharge cells having generated sustain discharge therein in the sustain period of the preceding sub-field, weak initializing discharge occurs, and weakens the wall voltage on scan electrode SCi and sustain electrode SUi. On data electrodes Dk, sufficient positive wall voltage is accumulated by the sustain discharge generated immediately before, and thus the excessive wall charge is discharged and the wall voltage is adjusted to a value appropriate for the address operation.

On the other hand, in the discharge cells having generated no sustain discharge therein in the preceding sub-field, no discharge occurs, and the wall charge at the completion of the setup period of the preceding sub-field is maintained. In this manner, in the selective initializing operation, the initializing discharge is performed selectively on the discharge cells subjected to the sustain operation in the sustain period of the preceding sub-field.

The operation in the succeeding address period is the same as the operation in the address period of the sub-field for the all-cell initializing operation. Thus, the description is omitted. The operation in the succeeding sustain period is the same except for the number of sustaining pulses.

Figure 6A:
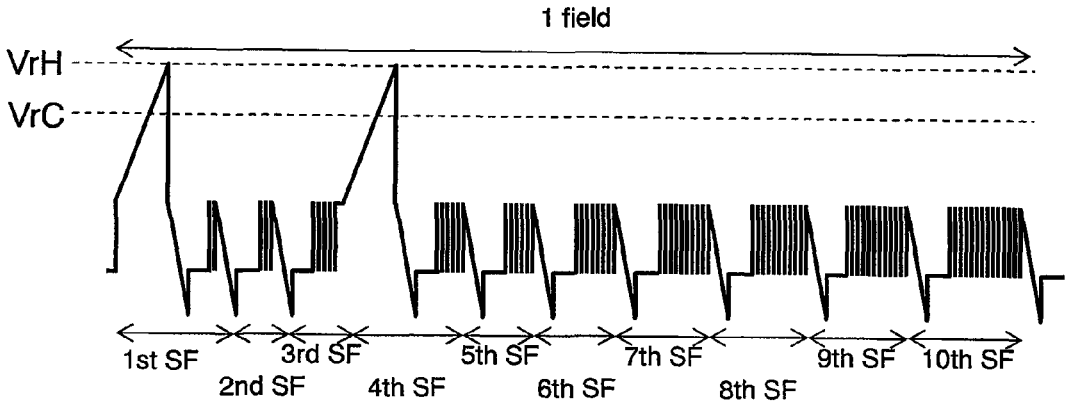
FIG. 6A is a diagram showing an example of a sub-field structure of a low-temperature driving mode in accordance with the first exemplary embodiment.
Figure 6B:
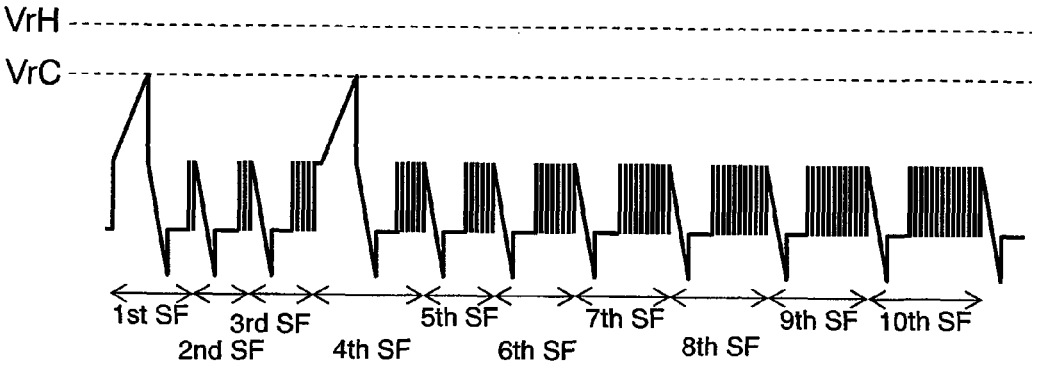
FIG. 6B is a diagram showing an example of a sub-field structure of an ordinary-temperature driving mode in accordance with the first exemplary embodiment.
Figure 6C:
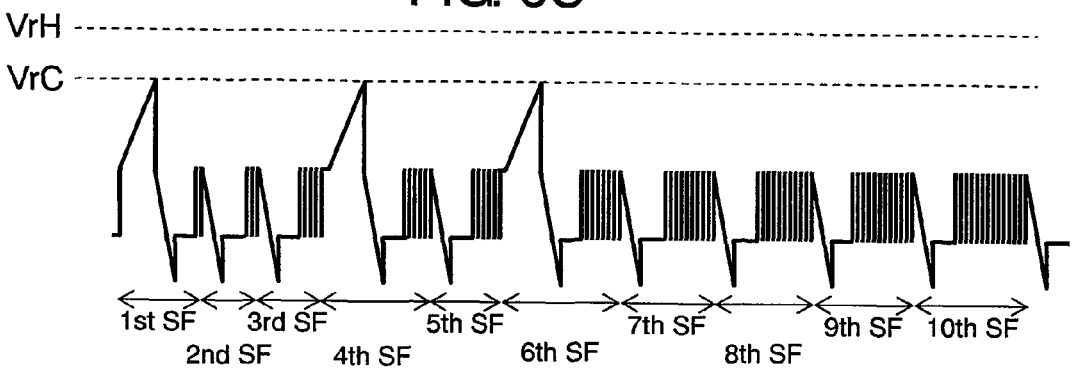
FIG. 6C is a diagram showing an example of a sub-field structure of a high-temperature driving mode in accordance with the first exemplary embodiment.

Next, a description is provided of sub-field structures. FIG. 6A, FIG. 6B, and FIG. 6C are diagrams illustrating sub-field structures of the first exemplary embodiment of the present invention. FIG. 6A, FIG. 6B, and FIG. 6C schematically illustrate the driving waveforms in one field in the sub-field method. The driving waveform in each sub-field is similar to the driving waveforms of FIG. 5.

This exemplary embodiment includes three diving modes: a low-temperature driving mode, an ordinary-temperature driving mode, and a high-temperature driving mode. These modes are switched by timing generating circuit 55. Described in this exemplary embodiment are cases where the maximum voltage to be applied to the scan electrodes or the number of applications of the maximum voltage is different in each of the above modes.

For each driving mode, one field is divided into 10 sub-fields (the first SF, and second SF to tenth SF). The respective sub-fields have different brightness weights (e.g. 1, 2, 3, 6, 11, 18, 30, 44, 60, and 80).

In the sustain period of each sub-field, the number of sustaining pulses resulting from multiplying the brightness weight of the sub-field by a predetermined luminance factor is applied to each of the display electrode pairs.

FIG. 6A is an example of the low-temperature driving mode. The low-temperature driving mode can provide stable image display even when the temperature of panel 10 is low. For example, this mode is used when a plasma display device is installed in a low-temperature environment and before the temperature of the panel increases immediately after power-on.

In the low-temperature driving mode in this exemplary embodiment, the all-cell initializing operation is performed in the first and fourth sub-fields (SFs), and the selective initializing operation is performed in the other SFs. Reset voltage Vr at this time is set to voltage VrH that is higher than setup voltage VrC of the ordinary-temperature driving mode and high-temperature driving mode, which are described later. This setting generates stronger discharge in the first half of the setup period, that is, provides a higher black picture level and slightly lower contrast than those of the ordinary-temperature driving mode. Now, the black picture level shows lighting unrelated to image display, i.e. the brightness of the area displaying a black picture.

FIG. 6B is an example of the ordinary-temperature driving mode. The ordinary-temperature driving mode is used in ordinary cases. In this exemplary embodiment, the all-cell initializing operation is performed in the first and fourth SFs, and the selective initializing operation is performed in the other SFs. Reset voltage Vr at this time is set to voltage VrC that is lower than setup voltage VrH of the low-temperature driving mode.

FIG. 6C is an example of the high-temperature driving mode. The high-temperature driving mode can provide stable image display even when the temperature of panel 10 is high. For example, this mode is used when a plasma display device is installed in a high-temperature environment and panel 10 reaches a high temperature because of high power consumption caused by displaying bright images or the like. In the high-temperature driving mode in this exemplary embodiment, the all-cell initializing operation is performed in the first, fourth, and sixth SFs and the selective initializing operation is performed in the other SFs. Reset voltage Vr at this time is set to voltage VrC that is equal to the setup voltage of the ordinary-temperature driving mode. In the high-temperature driving mode, such a larger number of all-cell initializing operations provide a slightly lower contrast than the ordinary-temperature mode.

Various kinds of methods can change setup voltage Vr. For example, the setup voltage can be changed by increasing voltage Vi1 to scan electrode SC1 or the ramp voltage slope from Vi1 to Vi2 of FIG. 5 to increase voltage Vi2.

Hereinafter, a description is provided of an example of a method of controlling setup voltage Vr in the all-cell initializing operation, with reference to the accompanying drawing.

Figure 7:
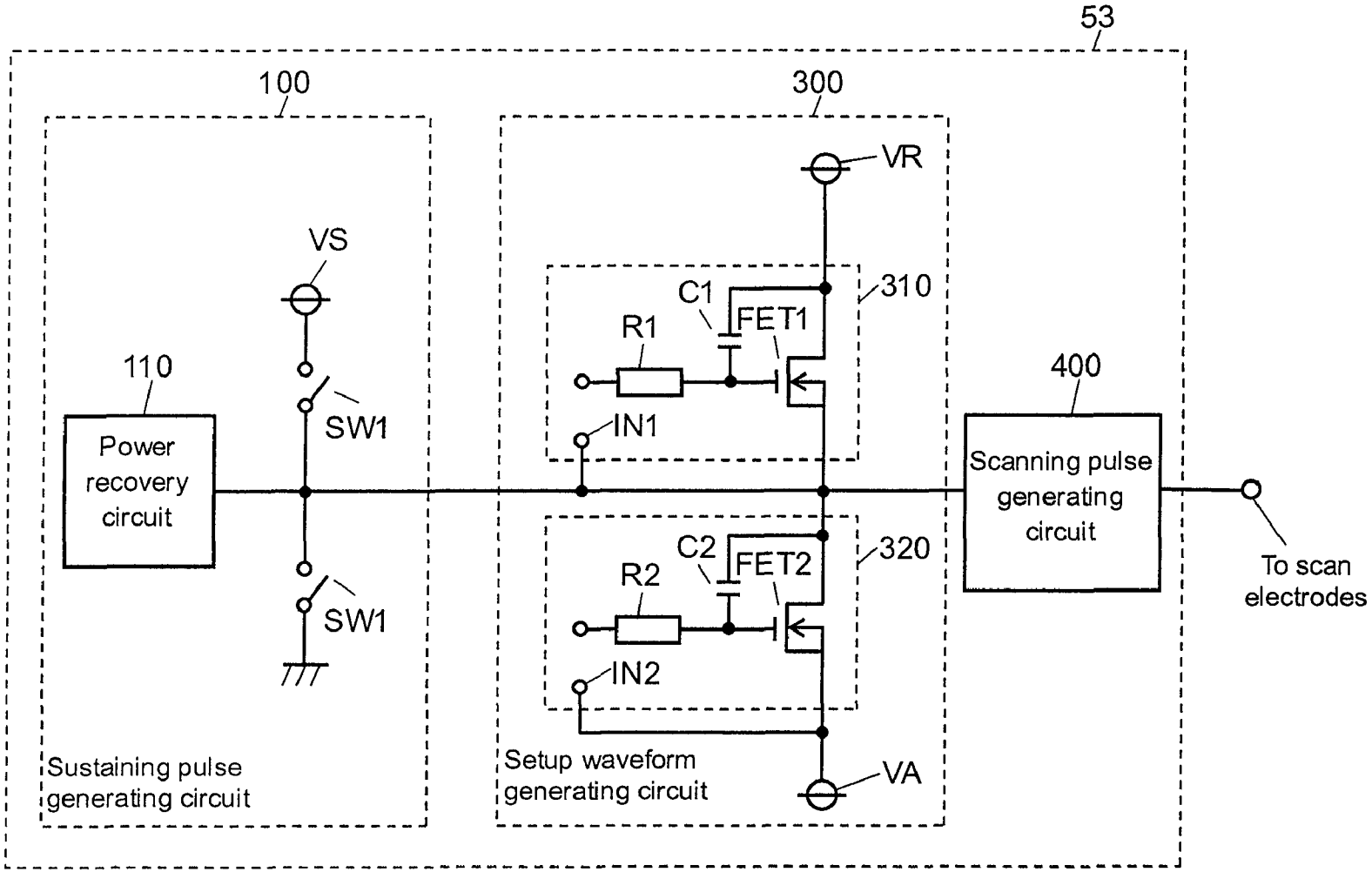
FIG. 7 is a circuit diagram of a scan electrodes driver circuit in accordance with the first exemplary embodiment.

FIG. 7 is a circuit diagram of scan electrodes driver circuit 53 of the first exemplary embodiment of the present invention. Scan electrodes driver circuit 53 includes sustaining pulse generating circuit 100 for generating sustaining pulses, setup waveform generating circuit 300 for generating setup waveforms, and scanning pulse generating circuit 400 for generating scanning pulses.

Sustaining pulse generating circuit 100 includes power recovery circuit 110 for recovering and recycling the power to be used to drive scan electrodes 22, switching element SW1 for cramping the voltage of scan electrodes 22 to Vs from power supply VS, and switching element SW2 for cramping the voltage of scan electrodes 22 to 0(V). Scanning pulse generating circuit 400 sequentially applies scanning pulses to scan electrodes 22 in the address period. In the setup period and the sustain period, scanning pulse generating circuit 400 outputs the voltage waveforms from sustaining pulse generating circuit 100 or setup waveform generating circuit 300 without any change.

Reset waveform generating circuit 300 includes Miller integrator circuits 310 and 320, generates the above setup waveforms, and controls setup voltage Vr in the all-cell initializing operation. Miller integrator circuit 310 includes field-effect transistor (FET) 1, capacitor C1, and resistor R1, and generates a ramp voltage gradually increasing to predetermined setup voltage Vr in ramp form. Miller integrator circuit 320 includes FET 2, capacitor C2, and resistor R2, and generates a ramp voltage gradually decreasing to predetermined setup voltage Vi4 in ramp form. In FIG. 7, the input terminals of Miller integrator circuits 310 and 320 are shown as terminals IN1 and IN2, respectively.

In this exemplary embodiment, Miller integrator circuits that are practical and have relatively simple structures are used as setup waveform generating circuit 300. However, the present invention is not limited to this structure. Any circuit capable of controlling setup voltage Vr and generating a ramp voltage may be used.

Figure 8:
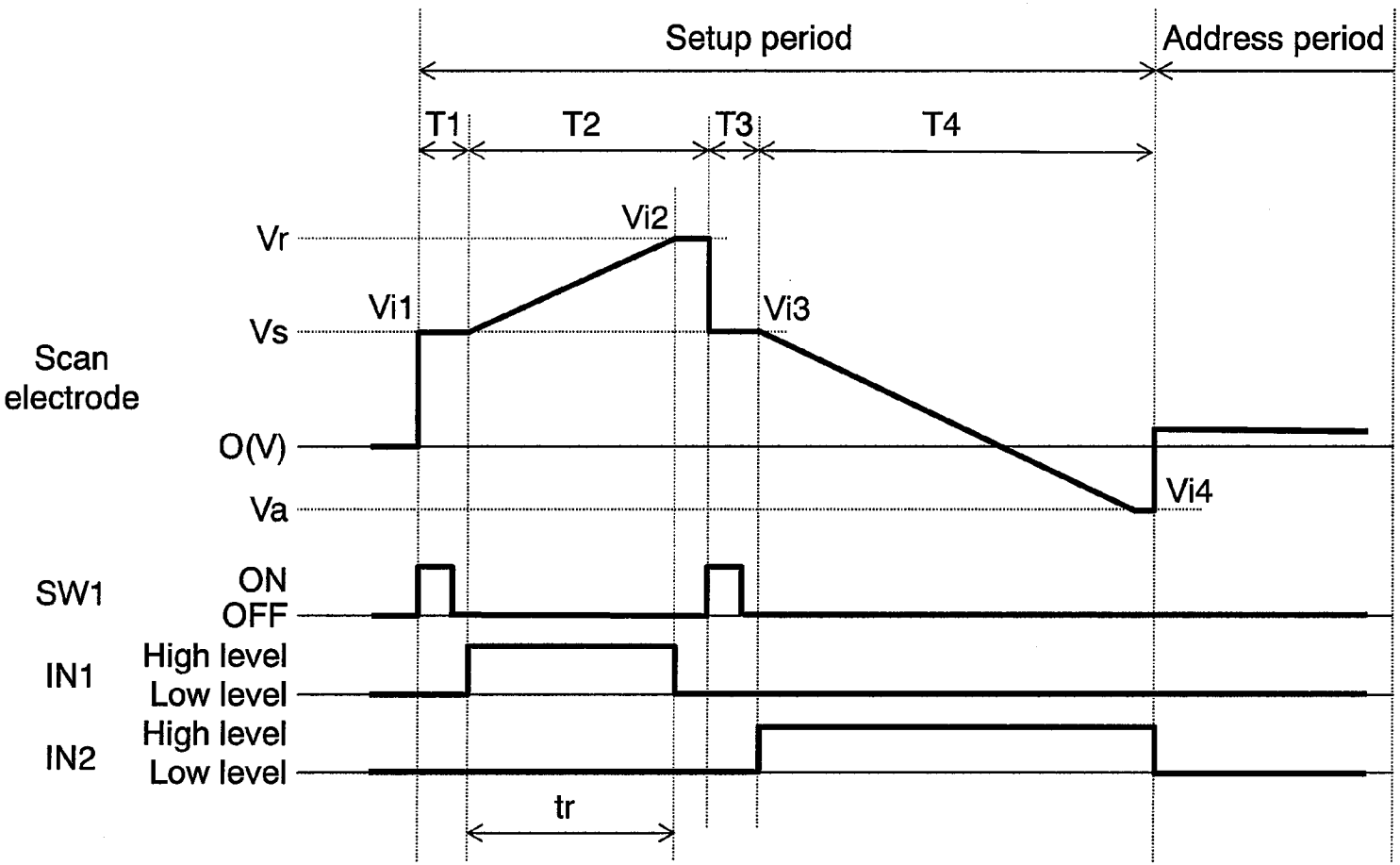
FIG. 8 is a timing diagram illustrating the operation of the scan electrodes driver circuit in an all-cell setup period in accordance with the first exemplary embodiment.

Next, a description is provided of the operation of setup waveform generating circuit 300. FIG. 8 is a timing diagram for describing the operation of scan electrodes driver circuit 53 in the all-cell setup period in the first exemplary embodiment of the present invention. Now, driving voltage waveforms for the all-cell initializing operation are divided into four periods shown by T1 through T4, and a description is provided for each period.

In this description, voltage Vi1 and voltage Vi3 are equal to voltage Vs. In the following description, the operation of bringing the switching elements into conduction is indicated as ON, and the operation of ceasing the conduction is indicated as OFF.

(Period T1)

First, switching element SW1 of sustaining pulse generating circuit 100 is turned on. Then, voltage Vs is applied to scan electrodes 22 via switching element SW1. Thereafter, switching element SW1 is turned off.

(Period T2)

Next, input terminal IN1 of Miller integrator circuit 310 is set at "high level". Specifically, application of a voltage of 15(V), for example, to input terminal IN1 passes a constant current from resistor R1 to capacitor C1 and increases the source voltage of FET1 in ramp form. Thereby, the output voltage of scan electrodes driver circuit 53 begins to increase in ramp form. This increase in voltage continues while input terminal IN1 is at "high level".

After the output voltage has increased to necessary setup voltage Vr, input terminal IN1 is set at "low level".

In this manner, a ramp voltage gradually increasing from voltage Vs of the breakdown voltage or lower (being equal to voltages Vi1 and Vi3 in this exemplary embodiment) to setup-voltage Vr exceeding the breakdown voltage (being equal to voltage Vi2 in this exemplary embodiment) is applied to scan electrodes 22.

At this time, setting time tr during which input terminal IN1 is at "high level" longer can increase setup voltage Vr. Setting time tr shorter can decrease setup voltage Vr.

(Period T3)

Next, switching element SW1 of sustaining pulse generating circuit 100 is turned on. Then, the voltage of scan electrodes 22 decreases to voltage Vs. Thereafter, switching element SW1 is turned off.

(Period T4)

Next, input terminal IN2 of Miller integrator circuit 320 is set at "high level". Specifically, application of a voltage of 15(V), for example, to input terminal IN2 passes a constant current from resistor R2 to capacitor C2 and decreases the drain voltage of FET2 in ramp form. Thereby, the output voltage of scan electrodes driver circuit 53 begins to decrease in ramp form. After the output voltage has reached negative voltage Vi4, input terminal IN2 is set at "low level".

In this manner, a ramp voltage gradually increasing from voltage Vi1 of the breakdown voltage or lower to setup-voltage Vr exceeding the breakdown voltage is applied to scan electrodes 22. Thereafter, a ramp voltage gradually decreasing from voltage Vi3 to Vi4 is applied to the scan electrodes.

With reference to FIGS. 6A, 6B, and 6C, to apply setup voltage VrH, time tr during which input terminal IN1 of scan electrodes driver circuit 53 is at "high level" is set longer in FIG. 8. To apply setup voltage VrC, time tr is set shorter.

Next, a description is provided of the reasons for switching three driving modes: the low-temperature driving mode, ordinary-temperature driving mode, and high-temperature driving mode.

When panel 10 is at a low temperature, the initializing discharge in the all-cell initializing operation tends to be destabilized by increases in breakdown voltage or other causes. This unstable initializing discharge can cause discharge failures, such as lighting of discharge cells that should not be lit in the succeeding address period. These discharge failures can be decreased by increasing setup voltage Vr in the all-cell setup sub-field.

Thus, in this exemplary embodiment, setup voltage Vr in the all-cell initializing operation in the low-temperature driving mode is set at voltage VrH higher than voltage VrC in the ordinary-temperature driving mode. This setting ensures a stable all-cell initializing operation and stable image display even when panel 10 is at a low temperature.

On the other hand, when panel 10 is at a high temperature, during address discharge in the discharge cells in a row, the wall charge in the discharge cells in the unselected rows is lost in the address period. This phenomenon can cause addressing failures in which insufficient wall voltage causes no address discharge when occurrence of the address discharge is desired.

To address this problem, in this exemplary embodiment, addressing failures are prevented by increasing the number of the all-cell initializing operations in the high-temperature driving mode to replenish insufficient wall charge. This structure can ensure stable image display even when panel 10 is at a high temperature.

As describe above, when panel 10 is at a high temperature or a low temperature, discharge failures, such as erroneous discharge and addressing failures, may occur. These discharge failures may degrade the display quality. However, in this exemplary embodiment, to decrease these discharge failures, three driving modes, i.e. the ordinary-temperature driving mode, high-temperature driving mode, and low-temperature driving mode, are switched by timing generating circuit 55.

Next, a description is provided of a method of switching the driving mode. Of course, the temperature of panel 10 is influenced by the temperature of an environment in which the plasma display device is installed. Further, the temperature varies with heat generated by the circuits for driving the panel, heat generated by the panel, and image signals influencing the heat in a complicated manner. For this reason, accurate detection of the temperature throughout the panel is difficult. Detecting the temperature of the panel with no influence given by momentarily changing display images requires a large number of thermal sensors disposed in the respective portions of the panel. This structure is not feasible.

In this exemplary embodiment, the temperature of panel 10 is not directly detected. Instead, this exemplary embodiment estimates the possibility that areas requiring driving in the low-temperature driving mode or high-temperature driving mode are generated in the display screen of the panel, switches the operating mode according to the result, and displays images so that discharge failures are inhibited.

Figure 9A:
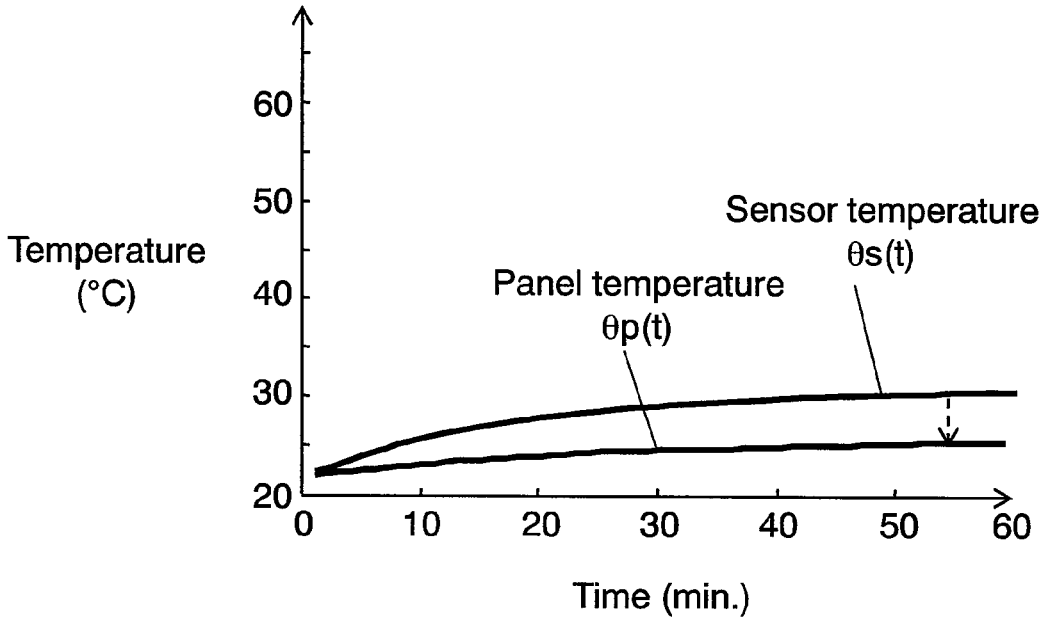
FIG. 9A is a graph of measurement results showing a relation between temperatures inside of a housing detected by a thermal sensor and temperatures of the panel when the panel displays an all-cell unlit pattern in the first exemplary embodiment.
Figure 9B:
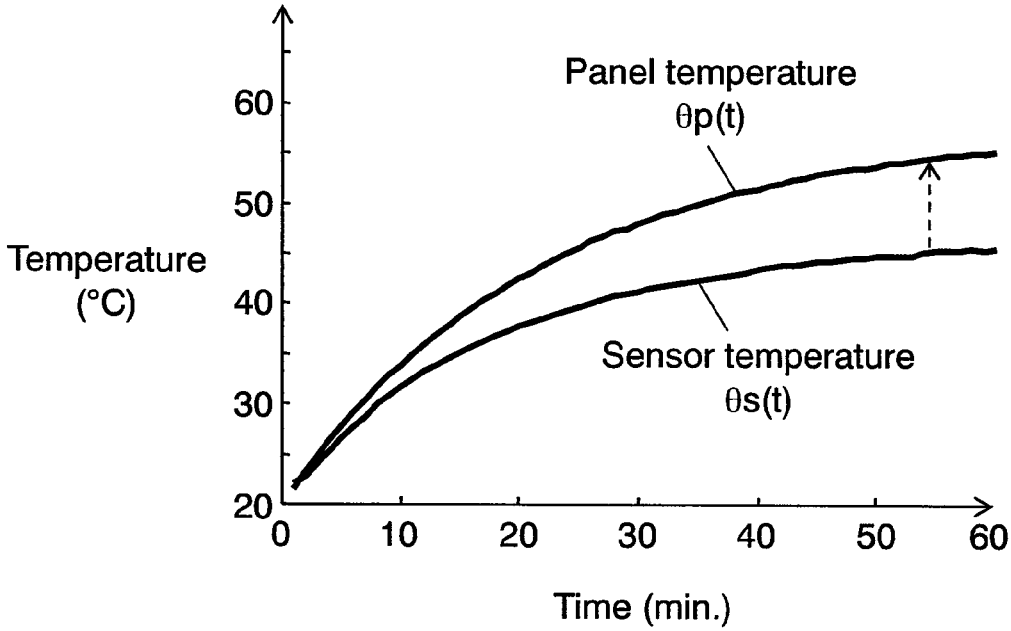
FIG. 9B is a graph of measurement results showing a relation between temperatures inside of the housing detected by the thermal sensor and temperatures of the panel when the panel displays an all-cell lit pattern in the first exemplary embodiment.

FIGS. 9A, 9B are graphs of measurement results showing the relation between temperature θs inside of the housing detected by thermal sensor 81 (hereinafter abbreviated as "sensor temperature") and temperature θp of panel 10 (hereinafter "panel temperature"). The ordinate axis indicates temperatures. The abscissa axis indicates time. During this measurement, thermal sensor 81 is disposed on the circuit board in no intimate contact with panel 10 so that sensor temperature θs is insusceptible to local temperatures of panel 10.

To estimate the lowest temperature panel 10 can have, an image causing the lowest temperature of panel 10, i.e. an all-cell unlit pattern, is displayed. The temperature of the areas lowest in panel 10 at this time is measured to provide the difference from sensor temperature θs.

FIG. 9A is a graph showing panel temperature θp and sensor temperature θs when the all-cell unlit pattern is displayed. After the plasma display device is powered on, sensor temperature θs gradually increases. On the other hand, panel temperature θp increases more gradually. This is because substantially no discharge generated in panel 10 makes heat generation of panel 10 small. In this exemplary embodiment, it is shown that the difference between sensor temperature θs and panel temperature θp becomes substantially constant after 10 to 20 minutes and panel temperature θp is approximately 7° C. lower than sensor temperature θs at that time. Thus, in this exemplary embodiment, low-temperature correction value ΔθL is set at 7° C., and the temperature obtained by subtracting low-temperature correction value ΔθL from sensor temperature θs is defined as estimated lowest temperature θL.

To estimate the highest temperature panel 10 can have, an image causing the highest temperature of panel 10, i.e. an all-cell lit pattern, is displayed. The temperature of the areas highest in panel 10 at this time is measured to provide the difference from sensor temperature θs.

FIG. 9B is a graph showing panel temperature θp and sensor temperature θs when the all-cell lit pattern is displayed. After the plasma display device is powered on, sensor temperature θs rapidly increases. On the other hand, panel temperature θp increases more rapidly. This is because panel 10 generates heat in addition to large power consumption of the driver circuits. Also in this exemplary embodiment, it is shown that the difference between sensor temperature θs and panel temperature θp becomes substantially constant after 10 to 20 minutes and panel temperature θp is approximately 10°

C. higher than sensor temperature θs at that time. Thus, in this exemplary embodiment, high-temperature correction value ΔθH is set at 10° C., and the temperature obtained by adding high-temperature correction value ΔθH to the sensor temperature is defined as estimated highest temperature θH.

In this exemplary embodiment, estimated lowest temperature θL and estimated highest temperature θH are obtained by the following equations:

$$\theta L(t)=\theta s(t)-\Delta\theta Lo$$

$$\theta H(t)=\theta s(t)+\Delta\theta Ho$$

In these equations, sensor temperature θs, estimated lowest temperature θL, and estimated highest temperature θH are indicated as θs(t), θL(t), and θH(t), respectively, to clearly show that these temperatures are the functions of time t. Further, ΔθLo and ΔθHo show that low-temperature correction value ΔθL and high-temperature correction value ΔθH are predetermined values (7° C. and 10° C., respectively, as shown above), i.e. constants.

Figure 10:
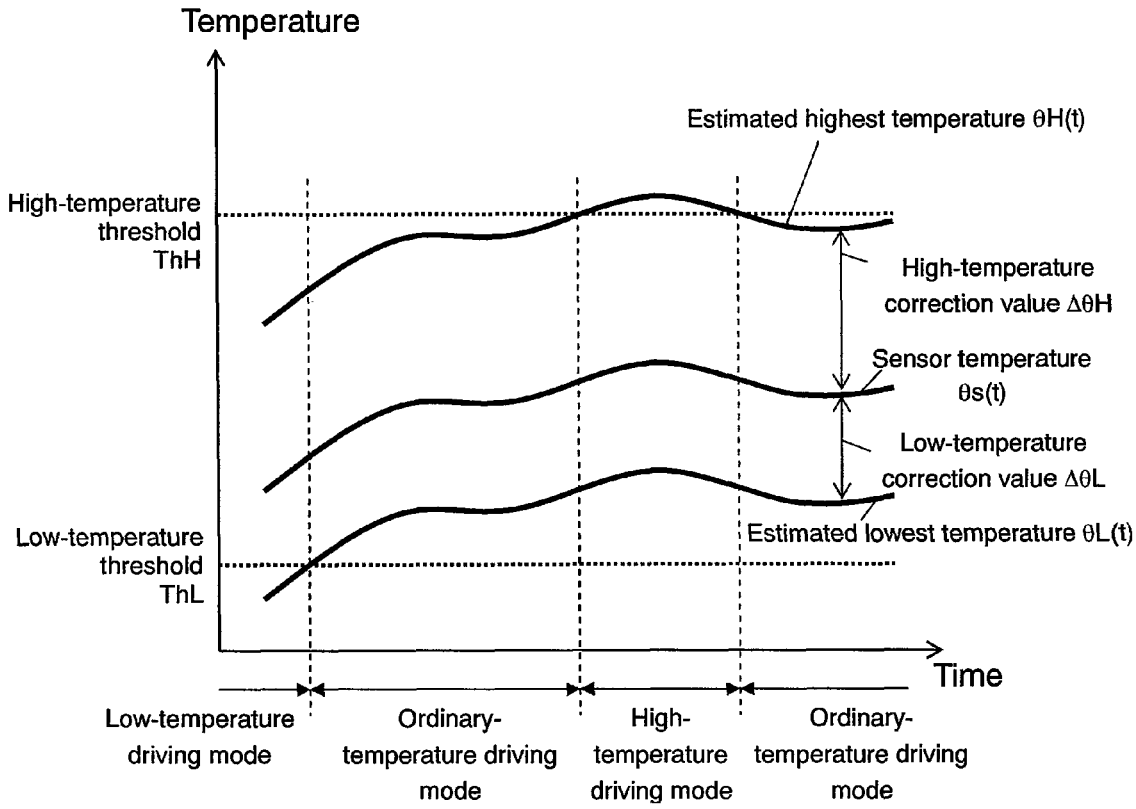
FIG. 10 is a graph showing a relation between estimated lowest temperatures, estimated highest temperatures, a low-temperature threshold, and a high-temperature threshold in the first exemplary embodiment.

FIG. 10 is a graph showing the relation between estimated lowest temperature θL, estimated highest temperature θH, low-temperature threshold ThL, and high-temperature threshold ThH. As shown in the graph, when estimated lowest temperature θL(t) is preset low-temperature threshold ThL or lower, the panel is driven in the low-temperature driving mode. When estimated highest temperature θH(t) is preset high-temperature threshold ThH or higher, the panel is driven in the high-temperature driving mode. In the other cases, the panel is driven in the ordinary-temperature driving mode.

As shown in FIGS. 9A and 9B, sensor temperature θs(t) is equal to panel temperature θp(t) immediately after power-on. As the time elapses, the difference between sensor temperature θs(t) and panel temperature θp(t) increases. Taking advantage of this phenomenon can improve accuracy of estimating the panel temperature. Hereafter, a description is provided of an exemplary embodiment for improving the accuracy of estimating the panel temperature.

Second Exemplary Embodiment

The structure of the panel and the outline of the driving voltage waveforms in the second exemplary embodiment of the present invention are the same as those of the first exemplary embodiment. The second exemplary embodiment is different from the first exemplary embodiment in the following points. A plasma display device of the second exemplary embodiment further includes timer 82 for measuring the time lapse after the plasma display device is powered on. In the second exemplary embodiment, low-temperature correction value ΔθL and high-temperature correction value ΔθH are not constants and are the functions of time, i.e. ΔθL(t) and ΔθH (t).

Figure 11:
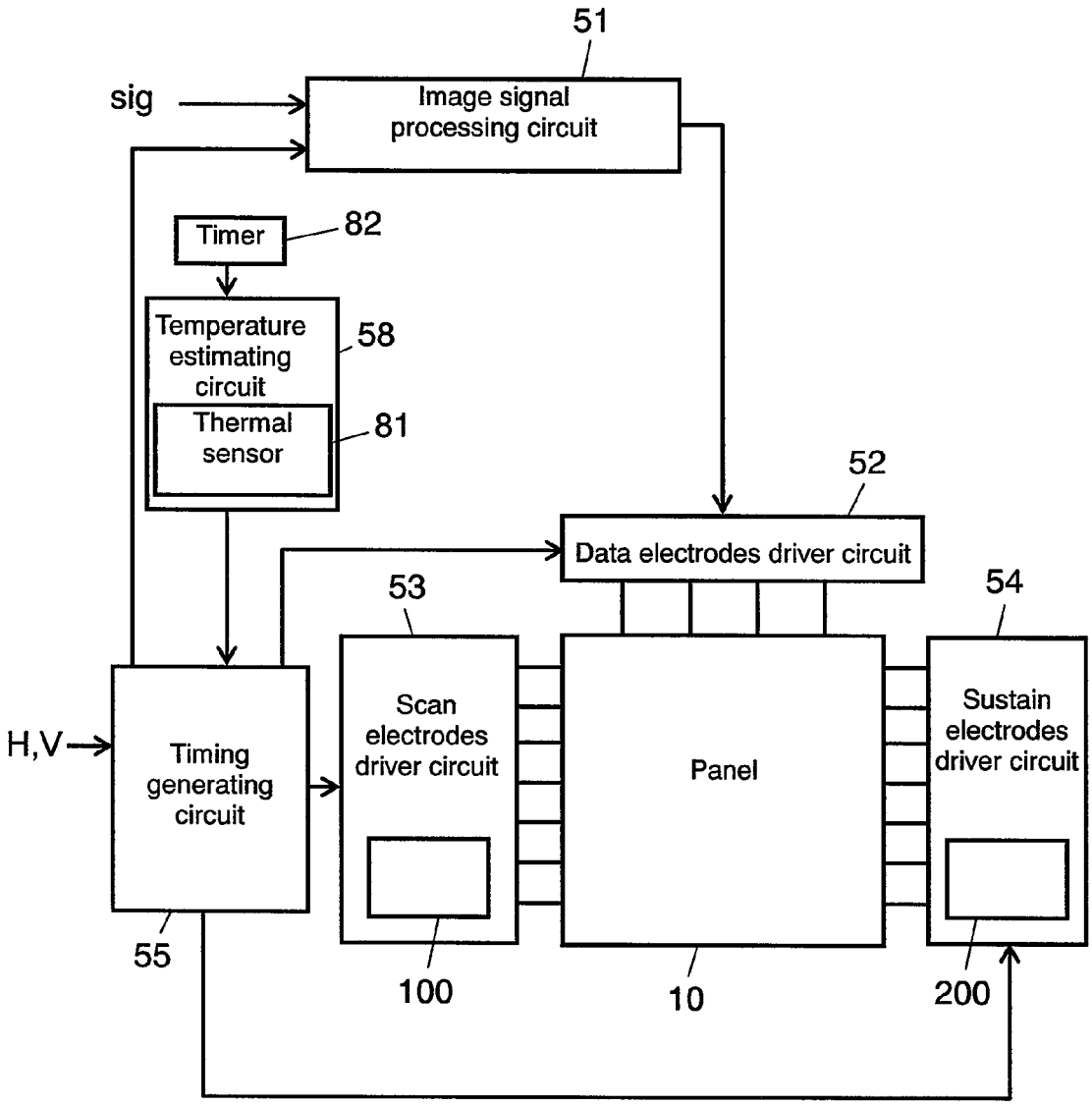
FIG. 11 is a circuit block diagram of a plasma display device in accordance with a second exemplary embodiment of the present invention.

FIG. 11 is a circuit block diagram of plasma display device 1 of the second exemplary embodiment of the present invention.

Timer 82 has a commonly-known time-measuring function for incrementing the counter every time unit time has elapsed. The timer measures time lapse t after the plasma display device is powered on and supplies time lapse t to temperature estimating circuit 58.

Temperature estimating circuit 58 includes thermal sensor 81. The temperature estimating circuit calculates estimated lowest temperature θL and estimated highest temperature θH, according to temperature θs inside of the housing detected by thermal sensor 81 and time lapse t supplied from timer 82.

Timing generating circuit 55 determines a driving mode according to estimated lowest temperature θL and estimated highest temperature θH supplied from temperature estimating circuit 58, generates various kinds of timing signals for driving panel 10 in the driving mode, and supplies the timing signals to each circuit block.

The other circuit blocks are the same as those of the first exemplary embodiment.

Next, a description is provided of a method of calculating estimated lowest temperature θL.

Figure 12A:
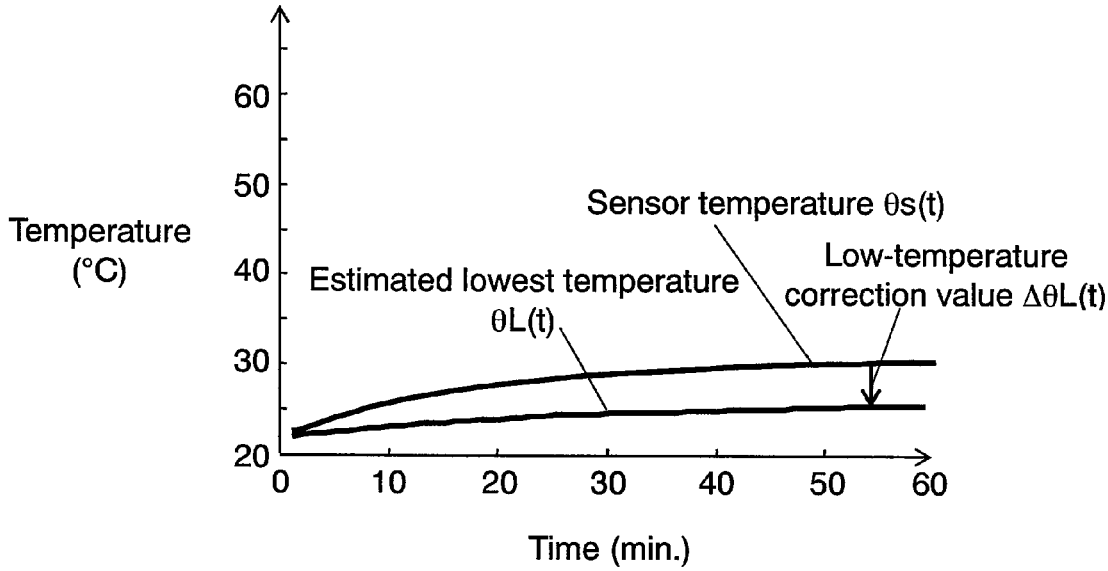
FIG. 12A is a graph showing low-temperature correction values, sensor temperatures, and estimated lowest temperatures when the panel displays an all-cell unlit pattern in the second exemplary embodiment.
Figure 12B:
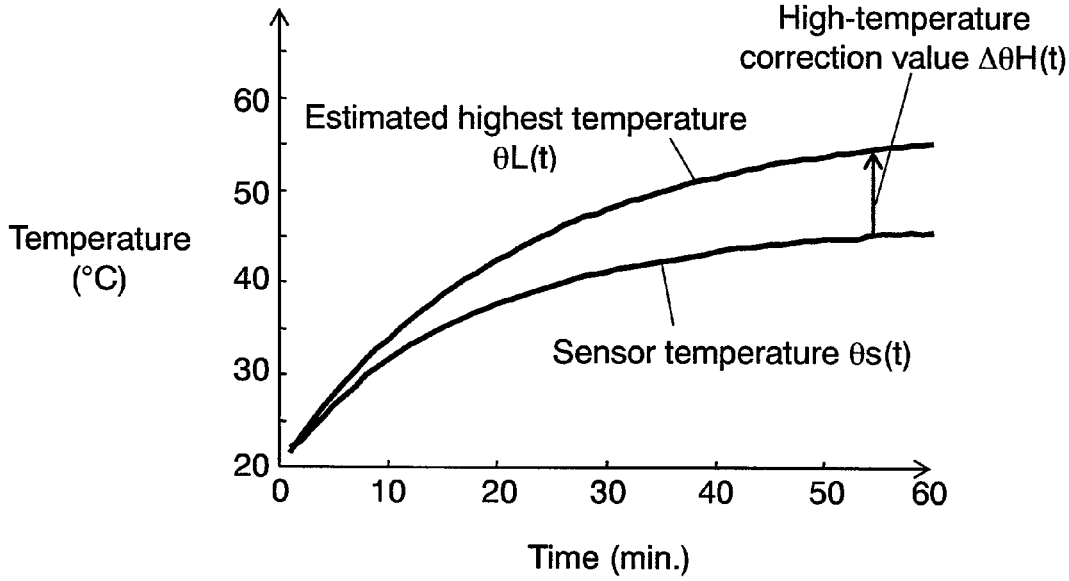
FIG. 12B is a graph showing high-temperature correction values, sensor temperatures, and estimated highest temperatures when the panel displays an all-cell lit pattern in the second exemplary embodiment.

FIGS. 12A and 12B are graphs showing low-temperature correction value ΔθL(t) and high-temperature correction value ΔθH(t), respectively, in the second exemplary embodiment of the present invention. First, a description is provided of low-temperature correction value ΔθL. FIG. 12A is a graph showing low-temperature correction value ΔθL, sensor temperature θs, estimated lowest temperature θL when an all-cell unlit pattern is displayed.

In this exemplary embodiment, low-temperature correction value ΔθL is set at 0 immediately after power-on and is a function that increases to predetermined value ΔθLo with time lapse t. Examples of the function of low-temperature correction value ΔθL include an exponential function, such as the following equation:

$$\Delta\theta L(t)=\Delta\theta Lo(1-\exp(t/tL))$$

wherein predetermined value ΔθLo is a temperature difference between sensor temperature θs and panel temperature θp after sufficient time has elapsed in FIG. 9A, and tL is a time constant of the exponential function.

Estimated lowest temperature θL is calculated by the following equation:

$$\theta L(t)=\theta s(t)-\Delta\theta L(t)$$

Estimated highest temperature θH can also be calculated according to the same idea.

FIG. 12B is a graph showing high-temperature correction value ΔθH, sensor temperature θs, estimated highest temperature θH when an all-cell lit pattern is displayed in this exemplary embodiment. In other words, high-temperature correction value ΔθH is set at 0 immediately after power-on and is a function that increases to predetermined value ΔθHo with time lapse t. Examples of the function of high-temperature correction value ΔθH include the following equation:

$$\Delta\theta H(t)=\Delta\theta Ho(1-\exp(t/tH))$$

wherein predetermined value ΔθHo is a temperature difference between sensor temperature θs and panel temperature θp after sufficient time has elapsed in FIG. 9B, and tH is a time constant of the exponential function.

Estimated lowest temperature θH is calculated by the following equation:

$$\theta H(t)=\theta s(t)+\Delta\theta H(t)$$

Calculating each of low-temperature correction value ΔθL (t) and high-temperature correction value ΔθH(t) as a function that changes from 0 to a predetermined value with time lapse t as described above allows estimated lowest temperature θL(t) to approach the panel temperature of FIG. 9A and allows estimated highest temperature θH(t) to approach the panel temperature of FIG. 9B. This setting provides more accurate estimation of the lowest temperature and the highest temperature the plasma display panel can have after power-on. Thus, the panel can be driven using the driving mode appropriate for the panel temperature.

As the form of the functions of low-temperature correction value ΔθL(t) and high-temperature correction value ΔθH(t), the above exponential functions are suitable. However, polygonal curve functions may be used in the following manner:

$$\Delta\theta L(t) = \Delta\theta Lo \times (t/tL)\ 0 \le t < tL$$
$$= \Delta\theta Lo\ t \ge tL$$

$$\Delta\theta H(t) = \Delta\theta Ho \times (t/tH)\ 0 \le t < tH$$
$$= \Delta\theta Ho\ t \ge tH$$

wherein tL is time when low-temperature correction value ΔθL(t) is equal to predetermined value ΔθLo, and tH is time when high-temperature correction value ΔθH(t) is equal to predetermined value ΔθHo.

Setting low-temperature correction value ΔθL(t) and high-temperature correction value ΔθH(t) as the functions of time lapse t as described above can improve the accuracy of estimating lowest temperature θL(t) and highest temperature θH(t). However, in this exemplary embodiment, the case where the plasma display device is powered off once and powered on again immediately after the power-off should be noted. Next, a description is provided of an exemplary embodiment in which the panel can be driven using a driving mode appropriate for the panel temperature even in such a case

Third Exemplary Embodiment

The structure of the panel and the outline of the driving voltage waveforms in the third exemplary embodiment of the present invention are the same as those of the second exemplary embodiment. The third exemplary embodiment is different from the second exemplary embodiment in the following points. A plasma display panel of the third exemplary embodiment further includes storage 83 for storing driving modes of the panel. Low-temperature correction value ΔθL(t) and high-temperature correction value ΔθH(t) are obtained, also depending on the output from the storage.

Figure 13:
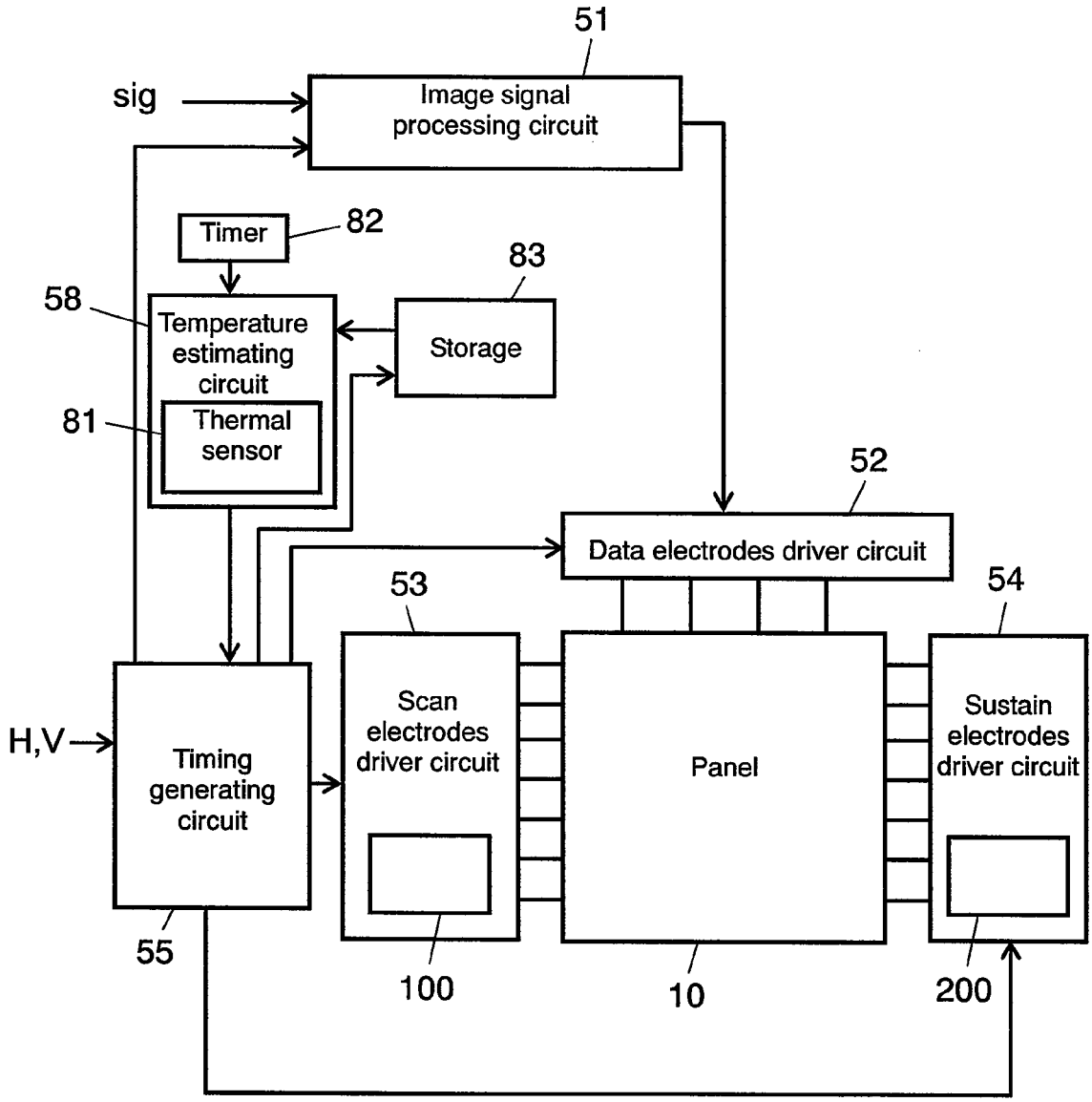
FIG. 13 is a circuit block diagram of a plasma display device in accordance with a third exemplary embodiment of the present invention.

FIG. 13 is a circuit block diagram of plasma display device 1 of the third exemplary embodiment of the present invention.

Similar to the second exemplary embodiment, timer 82 measures time lapse t after the plasma display device is powered on, and supplies time lapse t to temperature estimating circuit 58.

Storage 83 stores the driving modes of panel 10. The driving mode stored in storage 83 is always updated. When the plasma display panel is powered off, the updating operation is stopped. However, the stored driving mode is kept even after the power-off. Therefore, the driving mode stored in storage 83 when the plasma display device is powered on again is the driving mode immediately before the plasma display device is powered off. Hereinafter, the driving mode immediately before the power-off is referred to as "mode at power-off".

Temperature estimating circuit 58 includes thermal sensor 81. The temperature estimating circuit calculates estimated lowest temperature θL and estimated highest temperature θH, according to sensor temperature θs inside of the housing detected by thermal sensor 81, time lapse t supplied from timer 82, and the mode at power-off supplied from storage 83.

Then, timing generating circuit 55 determines the driving mode according to estimated lowest temperature θL(t) and estimated highest temperature θH(t) supplied from temperature estimating circuit 58, generates various kinds of timing signals for driving the panel in the driving mode, and supplies the signals to respective circuit blocks.

The operation in the other circuit blocks is the same as those of the first exemplary embodiment.

Next, a description is provided of a method of calculating estimated lowest temperature θL(t) and estimated highest temperature θH(t).

First, a description is provided of low-temperature correction value ΔθL(t) and high-temperature correction value ΔθH(t). FIG. 14 is a table showing low-temperature correction values ΔθL(t) and high-temperature correction values ΔθH(t) in the third exemplary embodiment. In this exemplary embodiment, low-temperature correction values ΔθL(t) and high-temperature correction values ΔθH(t) are different, depending on the modes at power-off in this manner.

As shown in FIG. 14, low-temperature correction value ΔθL(t) is set at constant value ΔθLo when the mode at power-off is the low-temperature driving mode. The Low-temperature correction value is a function dependent on time lapse t when the mode at power-off is the ordinary-temperature driving mode or high-temperature driving mode. FIG. 14 shows a function using an exponential function, as a function dependent on time lapse t. However, other forms of functions, such as a polygonal curve function, may be used.

On the other hand, high-temperature correction value ΔθH(t) is a function dependent on time lapse t when the mode at power-off is the ordinary-temperature driving mode or low-temperature driving mode. The high-temperature correction value is set at constant value ΔθHo when the mode at power-off is the high-temperature driving mode.

Estimated lowest temperature θL(t) and estimated highest temperature θH(t) are calculated by the following equations:

$$\theta L(t) = \theta s(t) - \Delta\theta L(t)$$

$$\theta H(t) = \theta s(t) + \Delta\theta H(t)$$

In this exemplary embodiment, the form of the function of low-temperature correction value ΔθL(t) is changed, depending on the modes at power-off for the following reasons.

For example, after a plasma display device is powered on, a relatively dark image is displayed. When sensor temperature θs is higher than low-temperature threshold ThL but panel temperature θp is lower than low-temperature threshold ThL, the plasma display device is powered off once, and is powered on immediately after the power-off.

In this case, because panel temperature θp is lower than low-temperature threshold ThL, the panel should be driven in the low-temperature driving mode. Assuming that low-temperature correction value ΔθL(t) is a function changing from 0 to predetermined value ΔθLo with time lapse t, t=0 immediately after power-on and thus low-temperature correction value ΔθL(0)=0. For this reason, estimated lowest temperature θL(t)=sensor temperature θs>low-temperature threshold ThL. Thus, the panel is driven in the ordinary-temperature driving mode.

However, in this exemplary embodiment, when the mode at power-off is the low-temperature driving mode, low-temperature correction value ΔθL(t) is set at constant value ΔθLo. Thus, estimated lowest temperature θL(t)=sensor temperature θs−ΔθLo<low-temperature threshold ThL. Consequently, the panel is properly driven in the low-temperature driving mode.

The form of the function of high-temperature correction value ΔθH(t) is changed, depending on the mode at power-off for the same reason. For example, after a plasma display device is powered on, a relatively bright image is displayed. When panel temperature θp is higher than high-temperature threshold ThH but sensor temperature θs is lower than high-temperature threshold ThH, the plasma display device is powered off once, and is powered on immediately after the power-off. In this case, because panel temperature θp is higher than high-temperature threshold ThH, the panel should be driven in the high-temperature driving mode.

Assuming that high-temperature correction value ΔθH(t) is a function changing from 0 to predetermined value ΔθHo with time lapse t, t=0 immediately after the power-on and thus high-temperature correction value ΔθH(0)=0. For this reason, estimated highest temperature θH(t)=sensor temperature θs<high-temperature threshold ThH. Thus, the panel is driven in the ordinary-temperature driving mode. However, in this exemplary embodiment, when the mode at power-off is the high-temperature driving mode, high-temperature correction value ΔθH(t) is constant value ΔθHo. Thus, estimated highest temperature θH(t)=sensor temperature θs+ΔθHo>high-temperature threshold ThH. Consequently, the panel is properly driven in the high-temperature driving mode.

Alternatively, it is possible that high-temperature correction value ΔθH(t) is not a function of time lapse t, and is set at constant value ΔθHo. FIG. 15 is a table showing low-temperature correction values ΔθL(t) and high-temperature correction value ΔθH(t) when high-temperature correction value ΔθH(t) is set at constant value ΔθHo in another exemplary embodiment of the present invention. FIG. 15 shows an example of using polygonal curve functions as the form of the functions of low-temperature correction values ΔθL(t) and high-temperature correction values ΔθH(t) according to the following equations:

$$\Delta\theta L(t) = \Delta\theta Lo \times (t/tL)\ 0 \le t < tL$$
$$= \Delta\theta Lo\ t \ge tL$$

$$\Delta\theta H(t) = \Delta\theta Ho \times (t/tH)\ 0 \le t < tH$$
$$= \Delta\theta Ho\ t \ge tH$$

wherein tL is time when low-temperature correction value ΔθL(t) is equal to predetermined value ΔθLo, and tH is time when high-temperature correction value ΔθH(t) is equal to predetermined value ΔθHo.

Low-temperature correction value ΔθL(t) is a function of time lapse t, or is set at a constant value. High-temperature correction value ΔθH(t) is not a function of time lapse t, and is set at constant value ΔθHo. The reasons for these settings are as follows.

The low-temperature driving mode is used when a plasma display device is installed in a low-temperature environment and before the panel is warmed up after power-on. Thus, when panel temperature θp is higher than low-temperature threshold ThL, there is substantially no possibility of the operation in the low-temperature driving mode after the panel is warmed up. For this reason, it is preferable that low-temperature correction values ΔθL(t) is calculated as a function dependent on time lapse t for estimated lowest temperature ΔθL(t) when the mode at power-off is the ordinary-temperature driving mode or the high-temperature driving mode.

However, panel temperature θp relatively rapidly increases when a bright image is displayed. Thus, when estimated highest temperature θH(t) obtained using a high-temperature correction value of constant value ΔθHo is high-temperature threshold ThH or higher, it is highly possible that panel temperature θp also exceeds high-temperature threshold ThH for a short period. For this reason, driving the panel in the high-temperature driving mode from the beginning presents no serious problem.

Figure 16A:
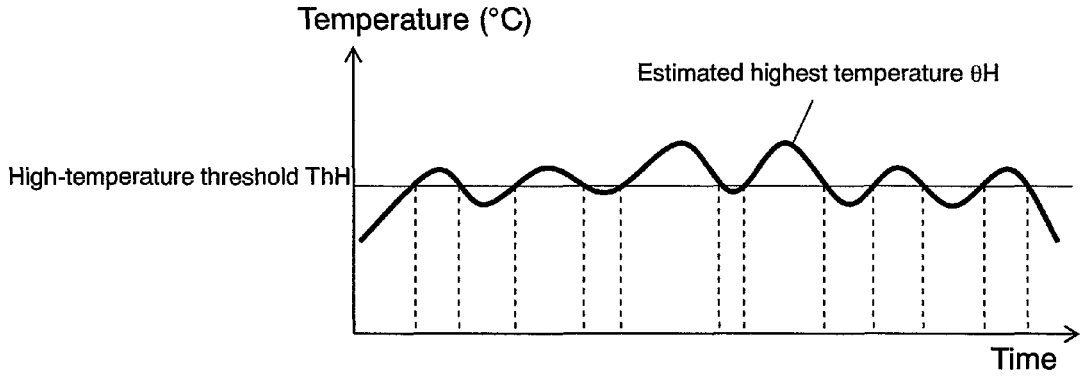
FIG. 16A is a graph showing an example of a relation between estimated highest temperatures and a high-temperature threshold in a setting without hysteresis characteristics in the third exemplary embodiment.
Figure 16B:
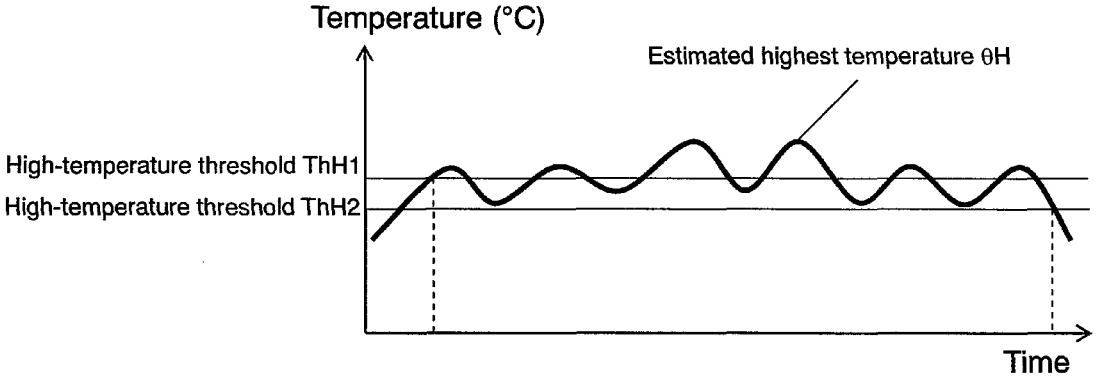
FIG. 16B is a graph showing an example of a relation between estimated highest temperatures and high-temperature thresholds in a setting with hysteresis characteristics in the third exemplary embodiment.

When the driving mode is switched, hysteresis characteristics may be provided to inhibit frequent switching of the driving mode. FIGS. 16A and 16B are graphs showing examples of the relation between estimated highest temperatures θH and high-temperature threshold ThH. When the driving mode is switched as described above, the brightness of the areas displaying black pictures (hereinafter "black picture level") varies. This is because the black picture level is determined by light emission caused by discharge in the all-cell initializing operation and dependent on the number of initializing operations and setup voltage Vr.

In this exemplary embodiment, the ordinary-temperature driving mode has two all-cell initializing operations in one field, and the high-temperature driving mode has three. Thus, frequent fluctuation of estimated highest temperature θH around high-temperature threshold ThH as shown in FIG. 16A frequently changes the number of the all-cell initializing operations and makes variations in black picture level more conspicuous.

To address this problem, for this exemplary embodiment, as shown in FIG. 16B, two high-temperature thresholds ThH1 and ThH2 are provided. Frequent switching of the driving mode is prevented by setting high-temperature threshold ThH1 for switching from the ordinary-temperature driving mode to the high-temperature driving mode higher than high-temperature threshold ThH2 for switching from the high-temperature driving mode to the ordinary-temperature driving mode to provide hysteresis characteristics.

Similarly, hysteresis characteristics may be provided for the low-temperature threshold.

In these exemplary embodiments, the xenon partial pressure of the discharge gas is 10%. Even at another xenon partial pressure, the driving voltage can be set according to the panel.

The various kinds of specific numerical values used in these exemplary embodiments simply show examples. Preferably, appropriate values are set according to the characteristics of the panel and specifications of the plasma display device as required.

Industrial Applicability

In a panel driving method and a plasma display device of the present invention, the highest temperature and the lowest temperature the panel can have are estimated according to the temperature detected by a thermal sensor and the driving mode selected at power-off. The plasma display device is driven according to the estimated highest temperature and the estimated lowest temperature. This structure can improve the image display quality. Thus, the present invention is useful as a panel driving method and a plasma display device.

The invention claimed is:

1. A method of driving a plasma display panel in which one field has a plurality of sub-fields and each of the sub-fields includes a setup period for generating initializing discharge in discharge cells, an address period for generating address discharge in the discharge cells, and a sustain period for generating sustain discharge in the discharge cells having generated the address discharge therein, and the plasma display panel includes a thermal sensor, the method comprising:

estimating a lowest temperature and a highest temperature of the plasma display panel, according to a temperature detected by the thermal sensor; and selecting one driving mode from a plurality of driving modes based on the estimated lowest temperature and the estimated highest temperature, the plurality of driving modes have at least one different operation in the setup period, each driving mode includes sub-fields having an all-cell initializing operation to initialize discharge in all of the discharge cells in the setup period, and the at least one different operation includes driving the sub-fields having the all-cell initializing operation with a different maximum voltage or the at least one different operation includes driving a different number of the sub-fields having the all-cell initializing operation with the different maximum voltage in the setup period;

the estimated lowest temperature is calculated by subtracting a low-temperature correction temperature from the detected temperature, the estimated highest temperature is calculated by adding a high-temperature correction temperature to the detected temperature, and at least one of the low-temperature correction temperature and the high-temperature correction temperature increases, depending on a time from a start of driving the plasma display panel to a predetermined value.

2. The method of driving a plasma display panel of claim 1, in which the driving modes includes at least a low-temperature driving mode to be used when the plasma display panel is at a low temperature, and a high-temperature driving mode to be used when the plasma display panel is at a high temperature, the method further including:

subtracting a predetermined low-temperature correction temperature from the temperature detected by the thermal sensor to calculate the estimated lowest temperature, and when the estimated lowest temperature is at most a predetermined low-temperature threshold, driving the plasma display panel in the low-temperature driving mode; and adding a predetermined high-temperature correction temperature to the temperature detected by the thermal sensor to calculate the estimated highest temperature, and when the estimated highest temperature is at least a predetermined high-temperature threshold, driving the plasma display panel in the high temperature driving mode.

3. The method of driving a plasma display panel of claim 2, wherein at least one of the low-temperature correction temperature and the high-temperature correction temperature is a predetermined value independent of time.

* * * * *

UNITED STATES PATENT AND TRADEMARK OFFICE

CERTIFICATE OF CORRECTION

PATENT NO. : 7,990,344 B2
APPLICATION NO. : 11/910345
DATED : August 2, 2011
INVENTOR(S) : Toshiyuki Maeda et al.

It is certified that error appears in the above-identified patent and that said Letters Patent is hereby corrected as shown below:

Cover Page

At item (56), OTHER PUBLICATIONS, please insert:

-- JP Office Action for Application No. 2007-525511, Oct. 19, 2010 --.

Signed and Sealed this
Thirteenth Day of March, 2012

David J. Kappos

David J. Kappos
*Director of the United States Patent and Trademark Office*